US011364405B2

(12) United States Patent
Hall

(10) Patent No.: US 11,364,405 B2
(45) Date of Patent: Jun. 21, 2022

(54) ISOMETRIC SYSTEM AND METHOD OF ACHIEVING PHYSICAL HEALTH

(71) Applicant: The Hall Method, Laguna Niguel, CA (US)

(72) Inventor: Marlene Hall, Laguna Niguel, CA (US)

(73) Assignee: The Hall Method, Laguna Niguel, CA (US)

( * ) Notice: Subject to any disclaimer, the term of this patent is extended or adjusted under 35 U.S.C. 154(b) by 136 days.

(21) Appl. No.: 17/001,631

(22) Filed: Aug. 24, 2020

(65) Prior Publication Data

US 2020/0384304 A1 Dec. 10, 2020

Related U.S. Application Data

(63) Continuation-in-part of application No. 15/233,673, filed on Aug. 10, 2016, now Pat. No. 10,751,560.

(60) Provisional application No. 62/203,303, filed on Aug. 10, 2015.

(51) Int. Cl.

| | |
|---|---|
| ***A63B 21/002*** | (2006.01) |
| ***A63B 26/00*** | (2006.01) |
| ***A63B 21/055*** | (2006.01) |

(52) U.S. Cl.

CPC ..... *A63B 21/0023* (2013.01); *A63B 21/0552* (2013.01); *A63B 26/003* (2013.01); *A63B 2208/0209* (2013.01); *A63B 2208/0247* (2013.01); *A63B 2208/0252* (2013.01); *A63B 2244/22* (2013.01)

(58) Field of Classification Search

CPC ..... A63B 21/0023; A63B 22/18; A63B 23/0222; A63B 22/16; A63B 26/003; A63B 2022/185; A63B 2023/006; A63B 21/0552; A63B 2208/0209; A63B 2208/0247; A63B 2208/0252; A63B 2244/22; A63B 2208/0204; A63B 2208/0242; A63B 2214/00; A63B 2225/62; A63B 2243/0037; A63B 2244/104; A63B 2244/106; A63B 2244/18

See application file for complete search history.

(56) References Cited

U.S. PATENT DOCUMENTS

| | | | |
|---|---|---|---|
| 5,006,002 | A | 4/1991 | Brodbeck |
| 5,180,349 | A | 1/1993 | Marcus |
| 6,547,706 | B1 | 4/2003 | Chek |
| 8,425,383 | B1 | 4/2013 | Kelly |
| 8,986,178 | B2 | 3/2015 | Klopman et al. |
| 9,387,363 | B1 | 7/2016 | Polinsky |

(Continued)

OTHER PUBLICATIONS

U.S. Appl. No. 15/233,673, filed Aug. 10, 2016, US 2017/0043200, U.S. Pat. No. 10,751,560.

(Continued)

*Primary Examiner* — Andrew S Lo
(74) *Attorney, Agent, or Firm* — UltimatEdge IP Law Group, P.C.; Dean G. Stathakis

(57) ABSTRACT

The present specification discloses an exercise system comprising a stable support purchase, such as a ballet barre, and an unstable support apparatus, such as a ball or a roller, wherein an individual may support a limb on the unstable support apparatus and selectively contact the stable support purchase for balance while performing an exercise, such as a ballet position, and an associated method comprising the steps of positioning at least one limb on the unstable support apparatus and simultaneously performing the exercise.

18 Claims, 9 Drawing Sheets

(56) References Cited

U.S. PATENT DOCUMENTS

| | | | |
|---|---|---|---|
| 9,732,956 | B2 | 8/2017 | Benedict |
| 2005/0209074 | A1 | 9/2005 | Barrows |
| 2005/0245372 | A1 | 11/2005 | Mylrea et al. |
| 2007/0027009 | A1 | 2/2007 | Arnold |
| 2008/0070210 | A1 | 3/2008 | Hitzmann |
| 2008/0312043 | A1 | 12/2008 | Cook |
| 2010/0167887 | A1 | 7/2010 | Berry |
| 2012/0238923 | A1 | 9/2012 | Yamashita et al. |

OTHER PUBLICATIONS

Ballet Science, "Basu Balance Trainer—Part 1, www.youtube.com/watch?v=20umUDSijlY (Jul. 13, 2012)."
Ballet West, "Technique-Balance Board, www.youtube.com/watch?v=FvRoNUnezo8 (Jan. 7, 2015)."
Calabrese, "Lower Body Barre Workout for Sculpted Legs, www.youtube.com/watch?v=y_m1aDs4J8o (Jul. 28, 2014; retrieved Oct. 10, 2016)."
EPO, "Article 94(3) EPC Examination Report for EP Patent Application Serial No. 16835850.5, pp. 5 (dated Nov. 19, 2019)."
EPO, "Seach Report for EP Patent Application Serial No. 16835850.5, pp. 7 (dated Jan. 8, 2019)."
Perform Better, ""Foam Roller Balance Training Exercises", Internet: <URL: http://www.performbetter.com/webapp/wcs/stores/servlet/PBOnePieceView?storeId=10151 &catalogId=10751 &pagename=502> (Apr. 17, 2016; retrieved Oct. 11, 2016)."
Pop Fit Studio, "Basu at the Barre to challenge your core, www.youtube.com/watch?v=e6YZh4KSY9s (Jun. 25, 2014)."
Shaw, "Classical Ballet Barre Full Workout, www.youtube.com/watch?v=G2obce-DjlE (Jan. 21, 2015; retrieved Oct. 10, 2016)."
Sophia, ""Barre Exercise List",Internet http://blog Internet: <URL: http://blog.codyapp.com/2013/07/01/barre-exercises/> (Jul. 1, 2013; retrieved Oct. 11, 2016)."
Theragear, "Swiss Ball Training Do's and Don'ts, swissball.com (2015)."
WIPO, "PCT Form IB 373, International Preliminary Report on Patentability for International Patent Application Serial No. PCT/US2016/046380, pp. 11 (dated Feb. 22, 2018)."
WIPO, "PCT Form ISA210 International Search Report for International Patent Application Serial No. PCT/US2016/046380, pp. 3 (dated Nov. 3, 2016)."
WIPO, "PCT Form ISA237 Written Opinion for International Patent Application Serial No. PCT/US2016/046380, pp. 9 (Nov. 3, 2016)."

ISOMETRIC SYSTEM AND METHOD OF ACHIEVING PHYSICAL HEALTH

This application is a continuation-in-part that claims the benefit of priority and is entitled to the filing date pursuant to 35 U.S.C. § 120 of U.S. patent application Ser. No. 15/233,673, filed Aug. 10, 2016, a 35 U.S.C. § 111 patent application which claims the benefit of priority and is entitled to the filing date of U.S. Provisional Patent Application 62/203,303, filed Aug. 10, 2015, the content of each of which is hereby incorporated by reference in its entirety.

A variety of human exercise and fitness programs are known for such purposes as strength training, conditioning, increasing flexibility, improving balance or quickness, and reducing risk of injury, just to name a few. Inherent in any such exercise programs there may be one or more stretching exercises (passive or active) and strengthening exercises (static or dynamic), with the branch of physiology known as kinesiology, or the study of body anatomy and mechanics in relation to human movement, factoring in. Focus may be on muscles or muscle groups, with further concern for joints and related ligaments and tendons.

Isometric exercise or "isometrics" is a type of strength training in which the joint angle and muscle length do not change during contraction, as compared to concentric or eccentric contractions, called dynamic or isotonic movements. Isometrics are done in static positions, rather than being dynamic through a range of motion. In an overcoming isometric, the joint and muscle work against an immovable object. In contrast, in a yielding isometric, the joint and muscle are held in a static position while opposed by resistance. Sometimes both overcoming and yielding isometric effects are achieved in the same exercise, depending on the muscle or muscle group.

In such exercise and muscle control and training there is of course a neurological component as well. Proprioceptive training is based on the concept that improved neuromuscular function is developed through controlled stimulation of the muscular system, thus requiring the muscles to adapt. This training has been used for many years by athletes and dancers. Rehabilitation and conditioning professionals use proprioceptive exercise to treat injuries and improve flexibility (e.g., proprioceptive neuromuscular facilitation ("PNF") that involves engaging a muscle or muscle group with an isometric contraction, then relaxing and stretching that muscle, sometimes with the assistance of a partner).

Classical ballet has proven to be a valuable strength and conditioning technique for a variety of other sports, from gymnastics and skating to running and martial arts, and for fitness and rehabilitative effects more generally, ballet embodying numerous challenging isometric and isotonic exercise movements as well as stretching and core and posture awareness. The ballet movement of rotating the legs from the hips helps to strengthen smaller, more injury-susceptible muscles, and by engaging these muscles, there is increased awareness of pelvis positioning and range of motion in the hips. Ballet technique also emphasizes verticality, wherein the body parts must be correctly centered and aligned to allow maximum stability and ease of movement, all serving to increase strength and flexibility, improve balance or quickness, and reduce risk of injury.

A ballet exercise routine typically begins at the barre, which the individual holds onto for support. These barre exercises warm up and stretch the muscles, work the tendons, and loosen the joints. Further aspects of ballet exercise, often called "center practice," are done without the support of the barre. In either case, slow, sustained exercises ("adagios") develop the individual's sense of balance and fluidity of movement while strengthening the muscles and ligaments and tendons involved, again whether at any point the exercise movement could be said to be isometric or isotonic. Overall, ballet workouts are generally useful for strengthening and developing a complete range of muscles: from the sternocleidomastoid (neck muscle) and deltoids (shoulders) to the trapezius (upper back), latissimus (lower back or "lats") and gluteus maximus (bottom) to the thighs (quadriceps or "quads" and hamstrings) and gastrocnemius muscles (calves). Such exercises have also shown to build lean muscle tissue and burn body fat as well as raise the resting metabolism rate, resulting in an overall effectiveness in calorie consumption and weight reduction.

The present specification addresses shortcomings of or improvements over traditional ballet exercise for strength training, conditioning, increasing flexibility, improving balance or quickness, reducing risk of or rehabilitating from injury, and the like. The present specification generally discloses the novel and beneficial concept of combining classical ballet exercises with an unstable support for improved effects.

SUMMARY

Aspects of the present invention teach certain benefits in construction and use which give rise to the exemplary advantages described below.

Aspects of the present specification provide method of employing an exercise system comprising a stable support purchase and an unstable support apparatus, wherein an individual may support a limb on the unstable support apparatus and selectively contact the stable support purchase for balance while performing an exercise.

Other aspects of the present specification provide an unstable support apparatus comprising a ball or a roller.

Other aspects of the present specification provide a method of employing such an exercise system comprising the steps of positioning at least one limb on the unstable support apparatus and simultaneously performing a ballet exercise.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1A:
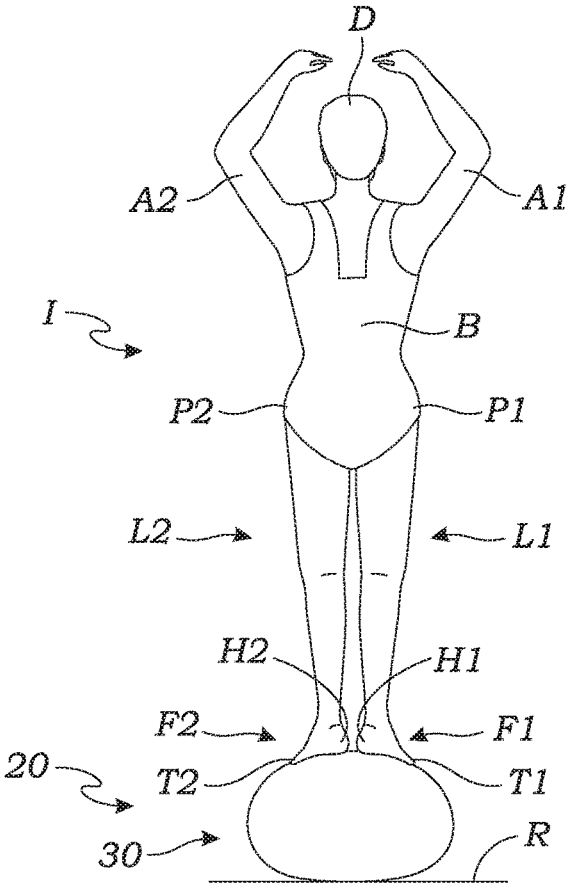
FIG. 1A illustrates a schematic back view of a first exercise involving a ball.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Aspects of the present specification relates generally to an isometric system and associated methods of movement and/or exercise employed with the isometric system. The disclosed isometric system utilizes an unstable support apparatus, a support surface, and optionally a stable support purchase or apparatus. This disclosed methods of movement and/or exercise incorporate partially or fully classical ballet or ballet-like movements and/or exercises.

In some embodiments, an isometric system and associated method involves incorporating training movements and/or exercises aimed at such objectives as strength training, conditioning, increasing flexibility, improving balance or quickness, and/or reducing risk of an injury, such as, e.g., an injury to a muscle, tendon or ligament. Essentially, there is disclosed the novel and beneficial concept of combining classical ballet isometric exercises with an unstable support for improved effects in training. Thus, an exercise system disclosed herein includes an unstable support apparatus, a support surface, and optionally a stable support purchase or apparatus which are employed to conduct a method of training. A exercise system disclosed herein can further include the use of elastic bands for some or all aspects of a method of training.

In some embodiments, an isometric system and associated method involves incorporating rehabilitation movements and/or exercises aimed at such objectives as strength training, conditioning, increasing flexibility, improving balance or quickness, and/or increasing recovery time from an injury, such as, e.g., an injury to a muscle, tendon or ligament. Essentially, there is disclosed the novel and beneficial concept of combining classical ballet isometric exercises with an unstable support for improved effects in rehabilitating from an injury, such as, e.g., an injury to a muscle, tendon or ligament. Thus, a rehabilitation system disclosed herein includes an unstable support apparatus, a support surface, and optionally a stable support purchase or apparatus which are employed to conduct a method of rehabilitating an injury. A rehabilitation system disclosed herein can further include the use of elastic bands for some or all aspects of a method of rehabilitating an injury.

In some embodiments, an isometric system and associated method involves a therapy incorporating therapeutic movements and/or exercises aimed at such objectives as strength training, conditioning, increasing flexibility, improving balance or quickness, and/or increasing recovery time from a disease affecting the muscular and/or skeletal systems. Essentially, there is disclosed the novel and beneficial concept of combining classical ballet isometric exercises with an unstable support for improved effects in treating a disease affecting the muscular and/or skeletal systems. Thus, a therapeutic system disclosed herein includes an unstable support apparatus, a support surface, and optionally a stable support purchase or apparatus which are employed to conduct a method of treating a disease affecting the muscular or skeletal systems. A therapeutic system disclosed herein can further include the use of elastic bands for some or all aspects of a method of treating a disease affecting the muscular or skeletal systems.

Aspect of the present specification disclose, in part, an unstable support apparatus. An unstable support apparatus disclosed herein is designed to shift or roll when employed by a user, which will be referred to as the loaded condition. In terms of the material(s) or attribute(s) of construction for any such unstable support apparatus, a wide variety of configurations are possible employing materials and techniques now known or later developed. By way of non-limiting illustration, an unstable support apparatus disclosed herein may be solid foam, foam-filled, inflatable, gas-filled, gel-filled, or liquid-filled and may be non-rigid and conformable such as foam or rubber and curved or capable of rolling. Any other such materials or attributes consistent with aspects of the present invention now known or later developed may be incorporated in the present invention without departing from its spirit and scope.

In some exemplary embodiments, an unstable support apparatus 20 is in the form of a ball 30 (FIGS. 1-6), a roller 40 (FIGS. 7-15), or a rotational disc. It will be appreciated that other such unstable supports that have a tendency to shift or roll may also be employed beyond the illustrated ball 30, roller 40, or rotational disc such that these three apparatuses are to be understood as merely exemplary and non-limiting. Other examples of unstable support apparatus disclosed herein that may be employed according to aspects of the present invention are a balance board and a wobble board.

Regarding ball 30 as unstable support apparatus 20, in the exemplary embodiment, such an exercise ball is selectively employed as having a diameter of from six inches (6 in.) to thirty-six inches (36 in.), the ball being non-rigid, conformable, and substantially spherical when at rest or in the unloaded condition. When used by an exerciser, or the loaded condition, the ball compresses into more of an oblong or oval shape, with an indentation forming at the point of contact with the exerciser, as shown in the figures. Accordingly, and more generally, all figures are schematics and are not to be taken literally or as being to scale. Assuming ball 30 at rest is a sphere having a diameter in the rage of 6-36 in. or thus a radius of from 3-18 in., it follows that the volume of ball 30, when unloaded, would be in the range of approximately one hundred cubic inches to twenty-five thousand cubic inches (100-25,000 $in^3$) according to the formula $V=4/3\cdot\pi\cdot r^3$ and the surface area of the ball would be in the range of approximately on hundred square inches to four thousand square inches (100-4,000 $in^2$) according to the formula $A=4\cdot\pi\cdot r^2$.

Regarding roller 40 as unstable support apparatus 20, in the exemplary embodiment, such an exercise roller is selectively employed as having a diameter of from two inches (2 in.) to twelve inches (12 in.) and further having an overall length in the range of approximately twelve inches (12 in.) to forty-eight inches (48 in.), the roller being non-rigid, conformable, and substantially cylindrical when at rest or in the unloaded condition. When used by an exerciser, or the loaded condition, the roller compresses at the point of contact, with an indentation forming at the point of contact with the exerciser, as shown in the figures. Accordingly, and more generally, all figures are schematics and are not to be taken literally or as being to scale. Assuming roller 40 at rest is a cylinder having a radius 1-6 in. and a length of from 12-48 in., it follows that the volume of roller 40, when unloaded, would be in the range of approximately forty cubic inches to five thousand cubic inches (40-5,000 $in^3$) according to the formula $V=\pi\cdot r^2\cdot L$ and the surface area of the roller would be in the range of approximately forty square inches to two thousand square inches (40-2,000 $in^2$) according to the formula $A=(2\cdot\pi\cdot r\cdot L)+(2\cdot\pi\cdot r^2)$.

Regarding a rotational disc as unstable support apparatus 20, in the exemplary embodiment, such an exercise rotational disc is selectively employed as having a diameter of from sic inches (6 in.) to fifteen inches (15 in.) and further having an overall height in the range of approximately 1 inch (1 in.) to three inches (3 in.). The rotational disc is generally composed of two rigid, non-conformable disc-shaped pieces that axially rotate relative to each other, e.g. a 180-degree rotation, a 270-degree rotation, or a complete 360-degree rotation.

Therefore, the range of the volume of unstable support apparatus 20 of the exemplary embodiment is approximately forty cubic inches to twenty-five thousand cubic inches (40-25,000 $in^3$) and the surface area is in the range of approximately forty square inches to four thousand square inches (40-4,000 $in^2$) with a primary or largest dimension in any direction effectively ranging from approximately two inches to forty-eight inches (2-48 in.). Those skilled in the art will once again appreciate that such sizes or size ranges are merely illustrative of features and aspects of the present invention and non-limiting.

Aspect of the present specification disclose, in part, a support surface. A support surface disclosed herein is designed to provide a non-moveable contact point for the unstable support apparatus while still enabling the unstable support apparatus to shift or roll along the support surface when the unstable support apparatus is employed by a user. A support surface disclosed herein includes, without limitation, one or more of a floor or a wall.

Aspect of the present specification disclose, in part, a stable support purchase or apparatus. A stable support purchase or apparatus disclosed herein is designed to provide a non-moveable contact point when employed by a user. A stable support apparatus disclosed herein helps an exerciser position, orient and/or maintain a proper body position while engaged in an exercise. A stable support apparatus disclosed herein includes, without limitation, one or more of a wall-mounted ballet barre, a floor-mounted ballet barre, a free-standing ballet barre, an elongated bar, an elongated rail, a handhold, and a foothold. In an exemplary embodiment, a stable support apparatus is a ballet barre 50.

Aspect of the present specification disclose, in part, a method of movement and/or exercise. A method of movement and/or exercise disclosed herein is designed to strengthen, condition, increase flexibility, improve balance, improve quickness, and otherwise improve the physical and mental health of an individual including improvement to the muscular, cardiovascular, respiratory, immune and/or skeletal systems. In an exemplary embodiment, the disclosed methods of movement and/or exercise incorporate partially or fully classical ballet or ballet-like movements and exercises.

Classical ballet or ballet-like movements and exercises typically begin from one of five foot positions, referred to as a first ballet foot position, a second foot ballet position, a third ballet foot position, a fourth ballet foot position, and a fifth ballet foot position. Generally, an individual will adopt these five positions in sequence to one another. For example, an individual will start in a first ballet foot position, then move into the second ballet foot position, then move into a third ballet foot position, then move into a fourth ballet foot position, and finally move into a fifth ballet foot position. However, as an individual becomes more skilled in ballet, a third ballet foot position can be dropped or skipped from the sequential foot movements of these positions.

In a first ballet foot position, an individual stands in substantially a vertical position with the first foot and the second foot positioned with toes turned equally out about 90 degrees from the sagittal plane and the heels of the first and second feet touching each other or in close proximity to each other, such as, e.g., the heels being no more than two inches apart. In a first ballet foot position, the feet and legs are also equally turned out.

In a second ballet foot position, an individual in a first ballet foot position will reposition by moving either the first foot or the second foot outward in a sagittal direction until approximately hip or shoulder width apart from the other foot. Upon completion of this movement the individual is standing in substantially a vertical position with the first foot and the second foot positioned with toes turned out about 90 degrees from the sagittal plane and heels approximately shoulder width apart from each other. In a second ballet foot position, the feet and legs are also equally turned out.

In a third ballet foot position, an individual in a second ballet foot position will reposition by moving either the first foot or the second foot inward in a sagittal direction until the heel of one foot is positioned to the middle of the other foot. Upon completion of this movement the individual is standing in substantially a vertical position with the first and second feet in close proximity to each other and in directional alignment with the sagittal plane and having each heel positioned to the middle of the other foot, the first foot and the second foot positioned with toes turned out about 90 degrees from the sagittal plane. In a third ballet foot position, the feet and legs are also equally turned out.

In a fourth ballet foot position, an individual in a third ballet foot position will reposition by moving the front foot forward (either the first foot or the second foot depending on which foot was positioned in front of the other in a third ballet position) until the front foot is positioned approximately one foot length apart of the other foot. Alternatively, in a fourth ballet position, an individual in a second ballet position if a third ballet position is not done, will reposition by moving either the first foot or second foot in front of the other foot until the first foot is positioned approximately one foot length apart of the second foot. Upon completion of this movement the individual is standing in substantially a vertical position with the first foot and the second foot and in directional alignment with the sagittal plane, approximately one foot length apart from each other, the first and second feet positioned with toes turned out about 90 degrees from the sagittal plane.

In a fifth foot ballet position, an individual in a fourth ballet foot position will reposition by moving the front foot back toward the other foot until the front foot is positioned in close proximity to the other foot so that the heel of one foot in aligned with the toes of the other foot and both feet are in directional alignment with the sagittal plane. Upon completion of this movement the individual is standing in substantially a vertical position with the first and second feet in close proximity to each other, with the heel of one foot in aligned with the toes of the other foot, and both feet are in directional alignment with, or parallel to, the sagittal plane.

Additional movements can be performed from any one of the five foot positions disclosed herein. These additional movements include, without limitation, one of the five basic arm movements disclosed herein, another arm position disclosed herein, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

Classical ballet or ballet-like movements and exercises typically have five basic arm positions, referred to as a first ballet arm position, a second arm ballet position, a third ballet arm position, a fourth ballet arm position, and a fifth ballet arm position. However, there is generally no correspondence between the five foot positions and the five arm positions. For example, just because an individual is standing in a fifth foot position, does not mean the arms of the individual will always also be in a fifth arm position.

In a first ballet arm position, an individual stands in substantially a vertical position with the first and second arms extended forward and are bent at the elbow to form a substantially oval shape, although the tips of the fingers of the first and second hands remain about four to six inches apart and do not touch. The first and second hands are slightly tilted so that the palms of the first and second hands are facing towards the face of the individual. Upon completion of this movement the individual is standing in substantially a vertical position with the first and second arms positioned in a substantially oval shape, the first and second arms being angled down slightly so the first and second hands are in the middle of the torso. The first and second elbows should be held higher that the first and second hands.

In a second ballet arm position, an individual in a first ballet arm position will reposition by moving the first and second elbows outward until the first and second arms are about 90 degrees from the sagittal plane while maintaining the same arm shape so that the elbows are higher than the hands with the hands slightly tilted upwards. Upon completion of this movement the individual is standing in substantially a vertical position with both arms outstretched about 90 degrees from the sagittal plane but otherwise maintaining the arm position adopted in the first arm position.

In a third ballet arm position, an individual in a first ballet arm position will reposition by moving either the first or second elbows outward until the first and second arms are about 90 degrees from the sagittal plane while maintaining the same are shape so that the elbows are higher than the hands with the hands slightly tilted upwards. In some embodiments of a third position disclosed herein, the other arm remains in a first arm position and does not move. In some embodiments of a third position disclosed herein, the other arm is moved outward about 90 degrees from the sagittal plane while maintaining the same are shape so that the elbows are higher than the hands with the hands slightly tilted upwards. Upon completion of this movement the individual is standing in substantially a vertical position with one arms outstretched about 90 degrees from the sagittal plane but otherwise maintaining the arm position adopted in the first arm position and the other arm 1) entirely maintains the arm position adopted in the first arm position; or 2) outstretched about 90 degrees from the sagittal plane but otherwise maintaining the arm position adopted in the first arm position.

In a fourth ballet arm position, an individual in a first ballet arm position will reposition by lifting either the first or second arm above the head to a vertical position, the arm being substantially in alignment with the torso. The palm of the hand of the lifted arm should be facing the face of the individual. In some embodiments of a fourth position disclosed herein, the other arm remains in a first arm position and does not move. In some embodiments of a fourth position disclosed herein, the other arm is moved outward about 90 degrees from the sagittal plane while maintaining the same are shape so that the elbows are higher than the hands with the hands slightly tilted upwards (the third ballet arm position). Upon completion of this movement the individual is standing in substantially a vertical position with one arm above the head to a vertical position the arm being substantially in alignment with the torso but otherwise maintaining the arm position adopted in the first arm position and the other arm 1) entirely maintains the arm position adopted in the first arm position; or 2) outstretched about 90 degrees from the sagittal plane but otherwise maintaining the arm position adopted in the first arm position.

In a fifth ballet arm position, also referred to as an en haut position, an individual in a first ballet arm position will reposition by lifting both arms above the head to a vertical position the arm being substantially in alignment with the torso while still maintaining the same hoop-like arm shape. The palm of the both the first and second hands should be facing the face of the individual. Upon completion of this movement the individual is standing in substantially a vertical position with both arms above the head to a vertical position the arm being substantially in alignment with the torso but otherwise maintaining the arm position adopted in the first arm position.

Other arm positions include bras bas where an individual positions the arms low and slightly rounded near the hip, a demi-bras where an individual positions the arms between first and second ballet arm positions and a demi-seconde where an individual positions the arms low out to the side palms generally down.

In some embodiments, an individual performs an adagio movement from any one of the first, second, third, fourth or fifth ballet foot positions. An adagio movement is a slow controlled movement that repositions one body part of an individual from a first position to a second position.

In some embodiments, an individual performs an allegro movement from any one of the first, second, third, fourth or fifth ballet foot positions. An allegro movement is a fast controlled movement that repositions one body part of an individual from a first position to a second position.

In some embodiments, an individual performs an allongé movement from any one of the first, second, third, fourth or fifth ballet foot positions. An allongé movement is a movement that extends or elongates a foot or leg of an individual.

In some embodiments, an individual performs an arabesque movement from any one of the first, second, third, fourth or fifth ballet foot positions. An arabesque movement is a movement where one leg of an individual is raised and extended straight behind the body while the individual stands on the other leg.

In some embodiments, an individual performs an attitude movement from any one of the first, second, third, fourth or fifth ballet foot positions. An attitude movement is a movement where one leg of an individual is raised and turned out with knee bent to form an angle of approximately 90° between the thigh and the lower leg while the individual stands on the other leg.

In some embodiments, an individual performs a balance movement from any one of the first, second, third, fourth or fifth ballet foot positions. A balance movement is a movement comprising a rocking sequence of three foot positions.

In some embodiments, an individual performs a balancire movement from any one of the first, second, third, fourth or fifth ballet foot positions. A balancire movement is a movement where one leg is swung forward and backwards while the individual stands on the other leg.

In some embodiments, an individual performs a ballonné movement from any one of the first, second, third, fourth or fifth ballet foot positions. A ballonné movement is a movement where one leg is extended at 45 degrees and the knee is bent and the foot is brought to the other leg between the base of the calf and the beginning of the ankle while the individual stands on the other leg.

In some embodiments, an individual performs a battement movement from any one of the first, second, third, fourth or fifth ballet foot positions. A battement movement is a movement where one leg is swung side-to-side while the individual stands on the other leg.

In some embodiments, an individual performs a battu movement from any one of the first, second, third, fourth or fifth ballet foot positions. A battu movement is a movement comprising extra beatings of the feet of the individual.

In some embodiments, an individual performs a cambré movement from any one of the first, second, third, fourth or fifth ballet foot positions. A cambré movement is a movement where an individual bends at the waist in any direction.

In some embodiments, an individual performs a dedans movement from any one of the first, second, third, fourth or fifth ballet foot positions. A dedans movement is a turning movement in the direction toward of the supporting leg, i.e., the leg that the individual is standing on. This is circular movement where a leg that starts at the back or the side moves towards the front In some embodiments, an individual performs a dehors movement from any one of the first, second, third, fourth or fifth ballet foot positions. A dehors movement is a turning movement in the direction away from the supporting leg, i.e., the leg that the individual is standing on. This is a circular movement where a leg that starts at the front or the side moves towards the back In some embodiments, an individual performs a developpe movement from any one of the first, second, third, fourth or fifth ballet foot positions. A developpe movement is a movement where a leg is lifted to cou-de-pied or retire and then fully extended outward, passing through attitude.

In some embodiments, an individual performs an échappe movement from any one of the first, second, third, fourth or fifth ballet foot positions. An échappe movement is a movement done from a closed (first or fifth) foot position to an open (second or fourth) foot position In some embodiments, an individual performs an entrechat movement from any one of the first, second, third, fourth or fifth ballet foot positions. An entrechat movement is a movement where the individual jumps into the aft and rapidly crosses the legs before and behind.

In some embodiments, an individual performs an épailé movement from any one of the first, second, third, fourth or fifth ballet foot positions. An épailé movement is a movement where the body is positioned at an oblique angle from the sagittal plane.

In some embodiments, an individual performs an epaulement movement from any one of the first, second, third, fourth or fifth ballet foot positions. An epaulement movement is a movement where the shoulders and head of an individual is rotated relative to the hips.

In some embodiments, an individual performs a fondu movement from any one of the first, second, third, fourth or fifth ballet foot positions. A fondu movement is a movement here the body of the individual is lowered by bending the knee of one leg, while the other leg is extended off the ground.

In some embodiments, an individual performs a jeté movement from any one of the first, second, third, fourth or fifth ballet foot positions. A jeté movement is a leaping movement in which one leg appears to be thrown in the direction of the movement.

In some embodiments, an individual performs a passé movement from any one of the first, second, third, fourth or fifth ballet foot positions. A passé movement is a movement where one foot is moved from front to back or vice versa while the individual stands on the other leg.

In some embodiments, an individual performs a penché movement from any one of the first, second, third, fourth or fifth ballet foot positions. A penché movement is a movement of tilting the body forward about the hip of the leg the individual is standing on so that the head is lower than the non-standing leg.

In some embodiments, an individual performs a piqué movement from any one of the first, second, third, fourth or fifth ballet foot positions. A piqué movement is a movement where a raised, pointed foot of one leg of an individual is lowered so that it touches the floor and then either is raised upward or that the individual's position shifts so that the individual is now standing on that foot.

In some embodiments, an individual performs a plié movement from any one of the first, second, third, fourth or fifth ballet foot positions. A plié movement is a movement comprising a smooth and continuous bending of the knees outward with the upper body held upright. Examples includes a demi-pile and a grand-pile.

In some embodiments, an individual performs a pointe movement from any one of the first, second, third, fourth or fifth ballet foot positions. A pointe movement is a movement where an individual raises on the tips of the toes.

In some embodiments, an individual performs a poisson movement from any one of the first, second, third, fourth or fifth ballet foot positions. A poisson movement is a movement where an individual arches the back and legs are crossed in fifth position or the working leg is held retire.

In some embodiments, an individual performs a port de bras movement from any one of the first, second, third, fourth or fifth ballet foot positions. A port de bras movement is a movement of the arms to two or more different positions.

In some embodiments, an individual performs a relevé movement from any one of the first, second, third, fourth or fifth ballet foot positions. A relevé movement is a movement where an individual raises onto the balls (demi-pointe) or toes (pointe) of one or both feet.

In some embodiments, an individual performs a retiré movement from any one of the first, second, third, fourth or fifth ballet foot positions. A retiré movement is a movement where a leg is raised turned out and bent at the knee to the side so that the toe is located directly in front of or behind the knee of the leg that this individual is standing on.

In some embodiments, an individual performs a tendu movement from any one of the first, second, third, fourth or fifth ballet foot positions. A tendu movement is a movement where a leg is gradually extended to the front, side or back passing from flat to demi-pointe to point where only the toes are touching the floor, or only the pointed toes are elevated.

An isometric system and associated methods of movement and/or exercise disclosed herein further comprises the use of a resistance apparatus in addition to an unstable support apparatus, a support surface, and optionally a stable support apparatus. A resistance apparatus disclosed herein is an exercise apparatus comprising an elastic portion useful in performing isometric movements and/or exercises and optionally a grip that facilitates the grasping of a resistance apparatus by an individual. Non-limning example of a resistance apparatus include a resistance band, a resistance tube, and a resistance loop.

In some embodiments, one end of a resistance apparatus disclosed herein is secured to a body part of an individual, such as, e.g., a hand, a wrist, a lower arm, an upper arm, a foot, an ankle, a lower leg, an upper leg, a waist, a torso or other body part where a beneficial effect is desired, and the other end of a resistance apparatus disclosed herein is secured to a fix location, which can be a stable support apparatus disclosed herein. Once both ends of a resistance apparatus disclosed herein are secured, an individual can perform any of the isometric movements and/or exercises disclosed herein including, without limitation, a ballet foot position disclosed herein, a ballet arm position disclosed herein, another arm position disclosed herein, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

In some embodiments, one end of a resistance apparatus disclosed herein is secured to a first body part of an individual, such as, e.g., a hand, a wrist, a lower arm, an upper arm, a foot, an ankle, a lower leg, an upper leg, a waist, a torso or other body part where a beneficial effect is desired, and the other end of a resistance apparatus disclosed herein is secured to a second body part of an individual, such as, e.g., a hand, a wrist, a lower arm, an upper arm, a foot, an ankle, a lower leg, an upper leg, a waist, a torso or other body part where a beneficial effect is desired, where the first and second body parts are different. Once both ends of a resistance apparatus disclosed herein are secured, an individual can perform any of the isometric movements and/or exercises disclosed herein including, without limitation, a ballet foot position disclosed herein, a ballet arm position disclosed herein, another arm position disclosed herein, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

Figure 1B:
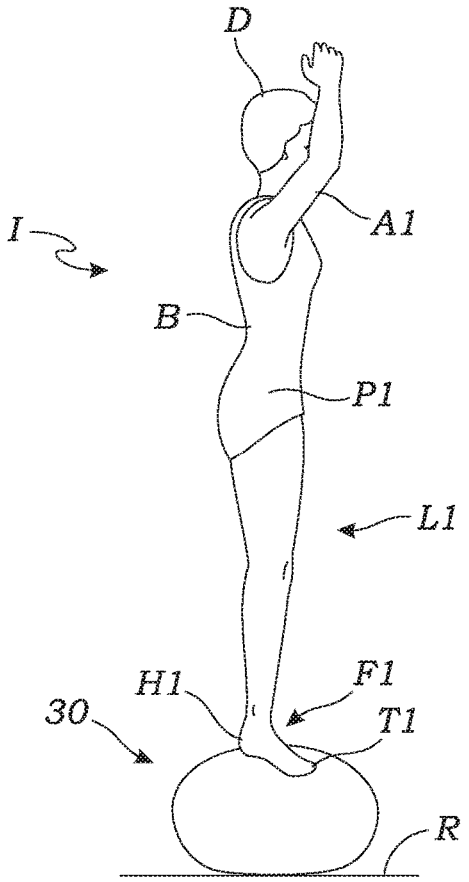
FIG. 1B illustrates a schematic side view thereof.

Referring first to FIGS. 1A and 1B, there is illustrated from the back and side an individual I standing on a ball 30 in a first ballet exercise. Specifically, the individual I has both feet F1, F2 positioned on the ball 30 so as to be in a substantially vertical, standing position thereon. Individual I is in the first ballet foot position with toes T1, T2 and hips P1, P2 are turned out so that the heels H1, H2 are in proximity. Individual I is in the fifth ballet arm position with arms A1, A2 are raised overhead in a relatively high, substantially oval shape and the back B is substantially straight and it and the head D are vertically aligned over the feet F1, F2 and the ball 30. It will be appreciated that in maintaining this position on an unstable support apparatus 20 such as the illustrated ball 30 the individual I must closely control muscle movement or contraction as in an isometric or static body position, thereby strengthening or conditioning the affected muscles, ligaments and tendons and improving balance. Particularly, the body is engaged in an overcoming isometric, the joints and muscles working against an immovable object, which is effectively the ball 30 as positioned on the floor R. In ballet parlance, the body position and hence the ballet exercise illustrated in FIGS. 1A and 1B is "Fifth En Haut."

Figure 2:
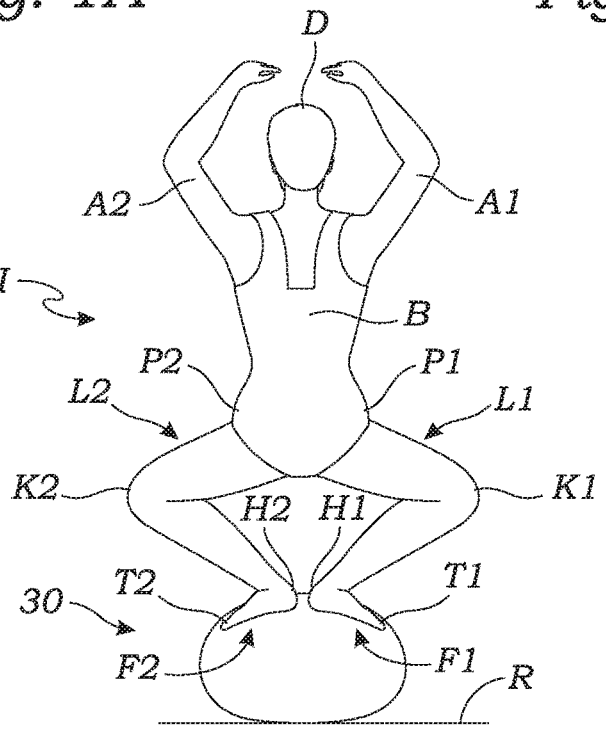
FIG. 2 illustrates a schematic back view of a second exercise involving a ball.

Turning now to FIG. 2, there is illustrated from the back the individual I still positioned on the ball 30 only now in a second ballet exercise position wherein the knees K1, K2 are deeply bent while balancing on the ball 30. Classic turnout at the hips P1, P2 is maintained with the toes T1, T2 pointed outward and the heels H1, H2 adjacent. The arms A1, A2 are still overhead with the back B and head D vertically aligned over the feet F1, F2 and the ball 30. Particularly, the legs L1, L2 are substantially directly above and in line with the toes T1, T2. This body position and ballet exercise as illustrated in FIG. 2 is called "Grande Plié." It will be appreciated that while such static positions are held for a period of time and so are effectively isometric exercises, and particularly overcoming isometrics, transitioning from one exercise to another, such as by going from the legs L1, L2 straight in the first exercise position of FIGS. 1A and 1B to deeply bent at the knees K1, K2 in the second exercise position of FIG. 2 and perhaps back again after each position is held does also involve dynamic movements and muscle contractions as well, also strengthening the muscles and related ligaments and tendons in a complimentary fashion, furthered due to the challenge of performing such exercises while balancing on an unstable support apparatus 20 such as the illustrated ball 30.

Figure 3:
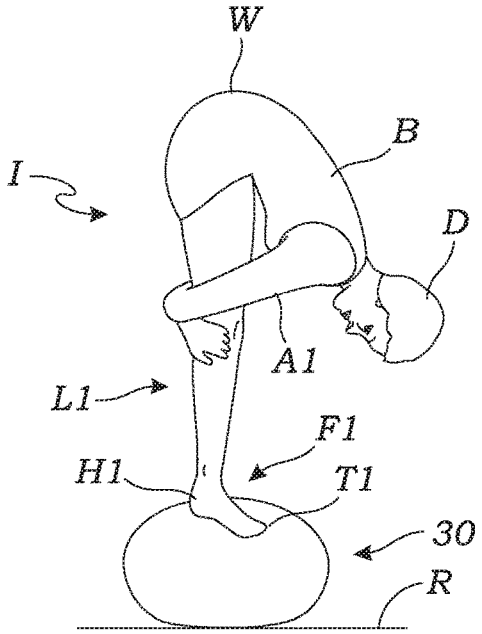
FIG. 3 illustrates a schematic side view of a third exercise involving a ball.

In FIG. 3, there is illustrated from the side the individual I still positioned on the ball 30 here in a third ballet exercise position wherein the knees K1, K2 and legs L1, L2 are again straightened as in the first exercise position of FIGS. 1A and 1B, only now the individual I bends at the waist W bringing the head D toward the feet F1, F2 again all while balancing on the ball 30. The toes T1, T2 are now directed a bit more forwardly in a classic "toe touch" stretch position, with the arms A1, A2 wrapped around the legs L1, L2 so as to hold the position. This third illustrated ballet exercise position may be described as "Cambre Forward in First Position." In one exemplary exercise system and method according to aspects of the present invention, the first three ballet exercises illustrated in FIGS. 1-3 are part of a "warm-up" typically done at the ballet barre 50 (FIG. 7 et al.) for on the order of fifteen minutes. As such, though not shown, as needed by the individual I, the barre 50 can be grasped or contacted for stability, particularly until the individual I becomes stronger or more skilled so as to perform such exercises on an unstable support apparatus 20 such as a ball 30 or roller 40 (FIG. 7 et al.) unaided.

Although illustrated using ball 30, the ballet exercised positions depicted in FIGS. 1-3 can be performed on any unstable support apparatus disclosed herein, including roller 40 and a rotational disc.

Figure 4A:
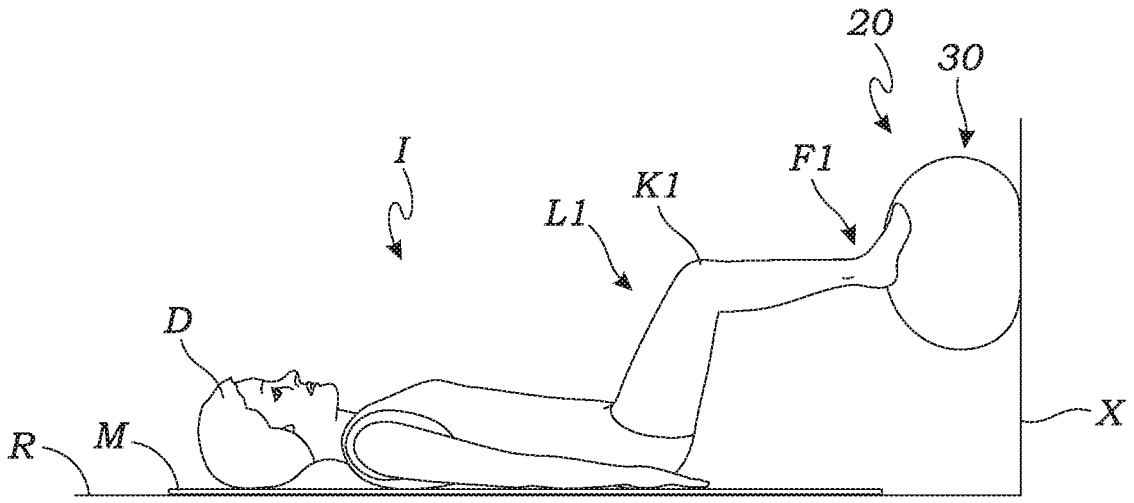
FIG. 4A illustrates a schematic perspective view of a fourth exercise involving a ball, in a first position.
Figure 4B:
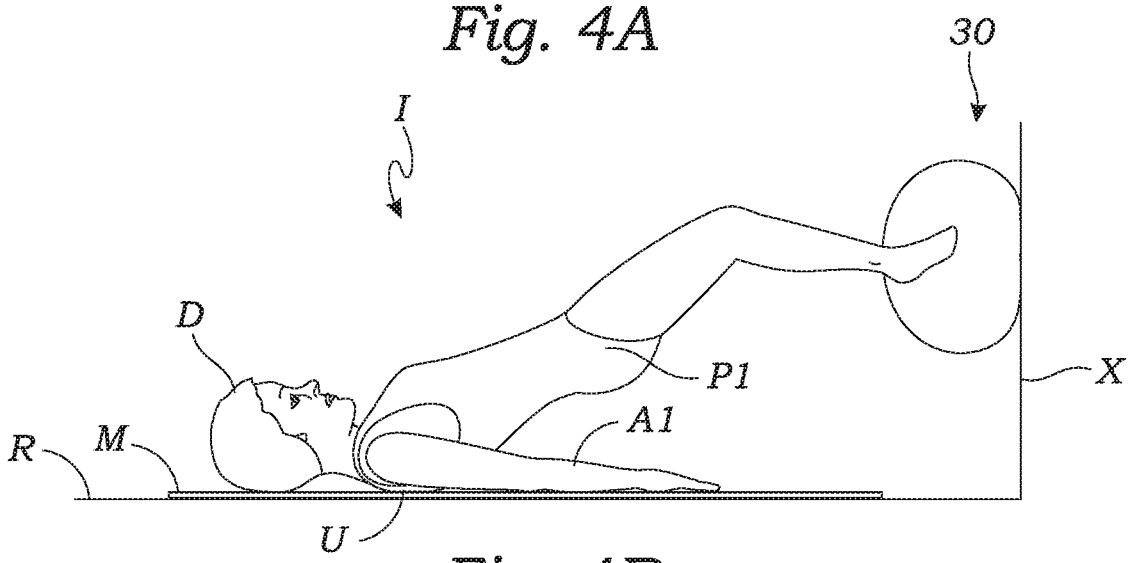
FIG. 4B illustrates a schematic perspective view thereof in a second position.
Figure 4C:
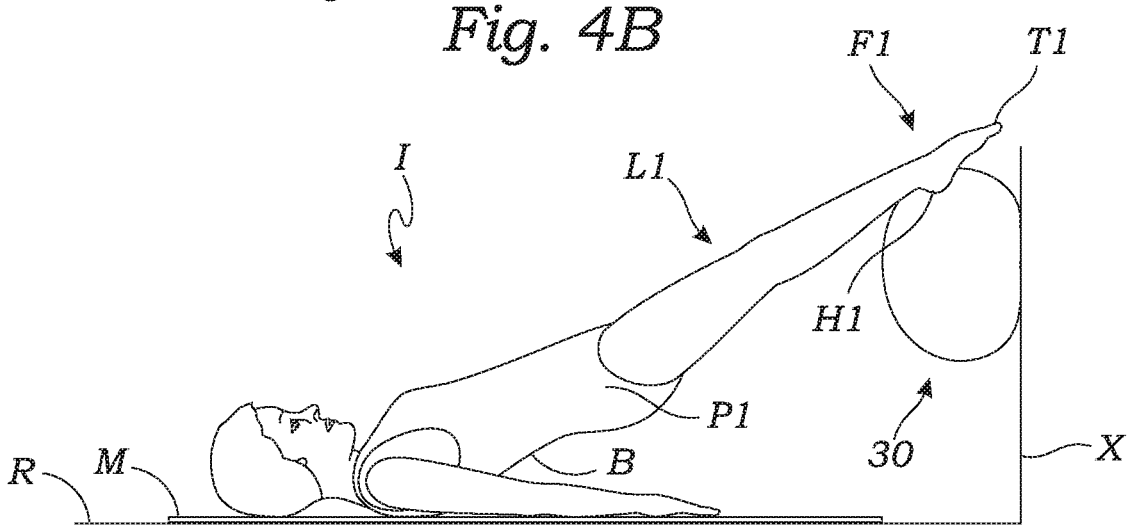
FIG. 4C illustrates a schematic perspective view thereof in a third position.

Turning to FIGS. 4A-4C, there are illustrated from the side three ballet exercises again performed using a ball 30 as the unstable support apparatus 20, though here while the individual I is oriented in a supine ("face up") position on the floor R with the ball 30 against an adjacent wall X. In the first ballet exercise position illustrated in FIG. 4A, the individual I is in a supine or "face up" position on the floor R with substantially the whole back B (FIGS. 1-3) and head D in contact with the floor R and knees K1, K2 bent with the feet F1, F2 in contact with the ball 30 substantially centrally so as to effectively pin it against the wall X. Though horizontal rather than vertical as typical, this ballet exercise illustrated in FIG. 4A is the "Demi Plié in Neutral Position." Shifting to the ballet exercise illustrated in FIG. 4B, the individual I brings her hips P1, P2 up off of the floor R into a "First Position Plank" such that only the upper back U, head D, and arms A1, A2 remain in contact with the floor R. Next, as illustrated in FIG. 4C, the individual I shifts her feet F1, F2 upwardly on the ball 30 as the legs L1, L2 are straightened into a "Full Plank" position with toes T1, T2 pointed and the heels H1, H2 on or in contact with the ball 30, and further wherein the back B and the legs A1, A2 are substantially aligned. It will again be appreciated that for the exercises illustrated in FIGS. 4A-4C, each may be held for a period of time in a static or isometric position before transitioning to the next exercise, with such transition being a dynamic muscle movement. For example, each discrete ballet exercise position may be held for on the order of two to four minutes and may be set to classical ballet music. An optional mat M is illustrated as being on the floor R beneath the individual I for additional support and comfort while performing the various exercises.

Figure 5A:
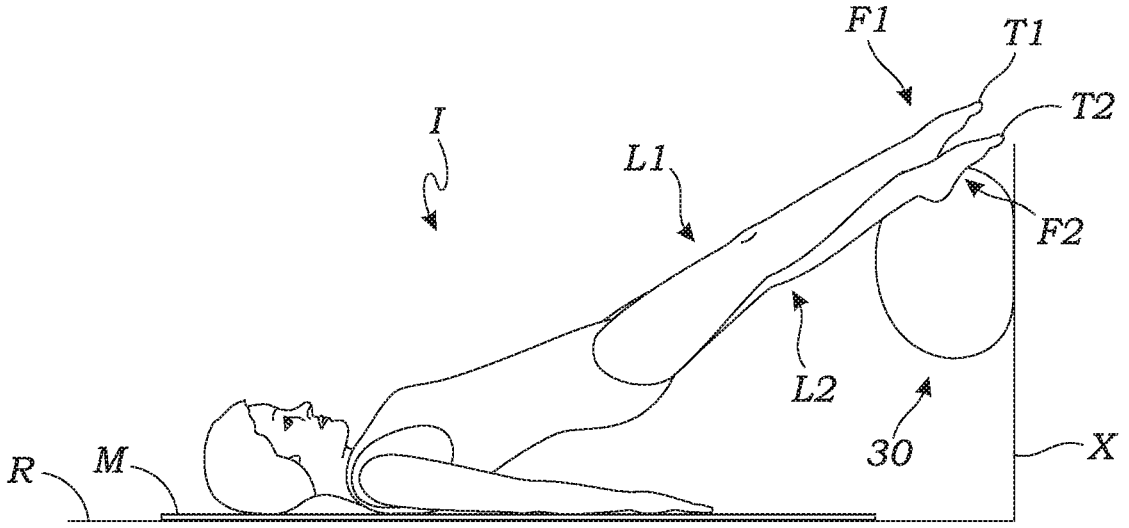
FIG. 5A illustrates a schematic perspective view of a fifth exercise involving a ball, in a first position.
Figure 5B:
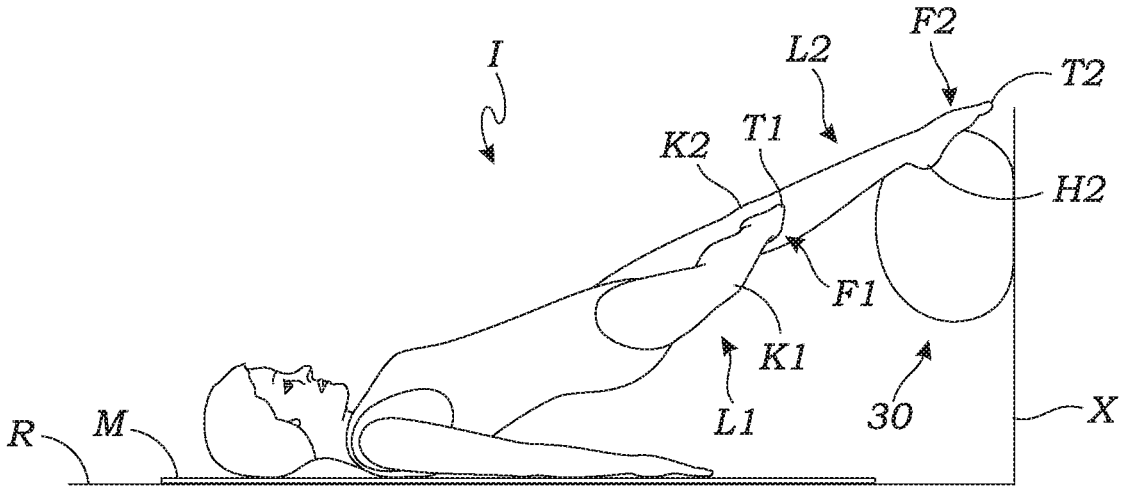
FIG. 5B illustrates a schematic perspective view thereof in a second position.

Referring next to FIGS. 5A and 5B, there are illustrated further ballet exercises performed substantially from the positions illustrated in FIGS. 4A-4C. That is, with the individual I still supine on the floor R and in a "Full Plank" position with her feet F1, F2 on the ball 30, as shown in FIG. 5A, the feet F1, F2 are crossed in a substantially tight leg position, with toes T1, T2 still pointed, which is an isometric ballet exercise position generally referred to as the "Sus-sous" position. Then, as illustrated in FIG. 5B, the first leg L1 is bent at the knee K1 so as to shift the first foot F1 off of the ball 30 and away from the crossed, tight leg "Sus-sous" position with the other foot F2 and into proximity with the knee K2 of the second leg L2 that remains straight, with the second foot F2, and particularly the heel H2, still in contact with the ball 30. In this manner, the individual I shifts to a further isometric ballet exercise position generally referred to as the "Passe" position. It will be appreciated that here the "Full Plank" position is maintained while only one leg L2 is contact with the unstable support apparatus 20 (ball 30 here), which leg is often referred to as the "support leg," while the other leg L1 is off of the support apparatus 20 and in a different position, which free or shifted leg is often referred to as the "active leg" or "working leg." It will be further appreciated that while in the illustrated embodiment of FIGS. 5A and 5B the support leg is the left leg L2 and the active leg is the right leg L1, the same ballet exercise can be performed with the legs reversed. In fact, in accordance with one exemplary embodiment, the exercise system and method entails performing such isometric ballet exercises on both "sides" (left and right in alternating fashion), and typically multiple two- to four-minute sets per side; for example, four sets on each of the right and left sides. For each set, there may be a combination of dwells in one of the two illustrated isometric or static positions or more frequent transitions to and from each of the "Sus-sous" and "Passe" positions.

Figure 6A:
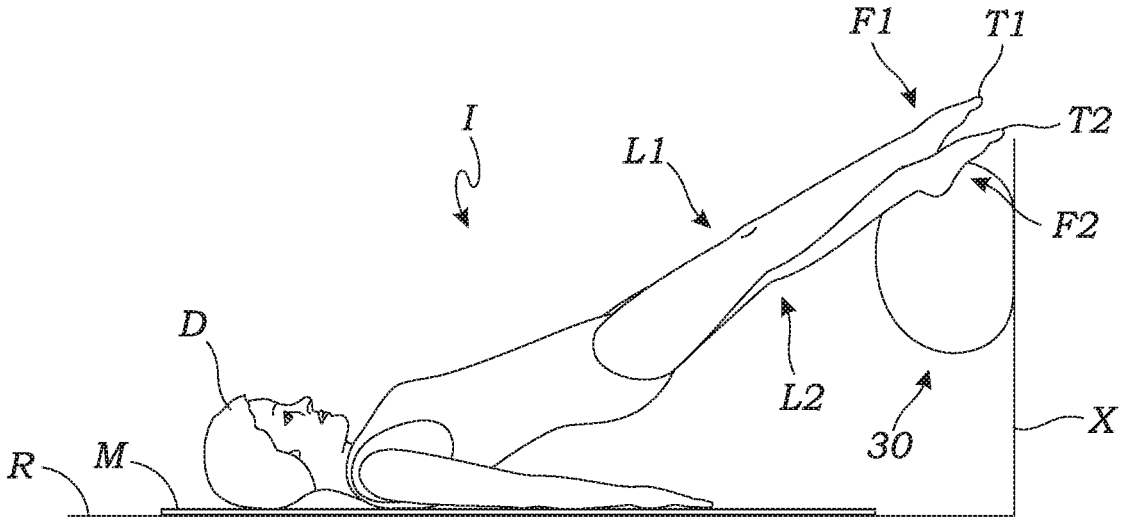
FIG. 6A illustrates a schematic perspective view of a sixth exercise involving a ball, in a first position.
Figure 6B:
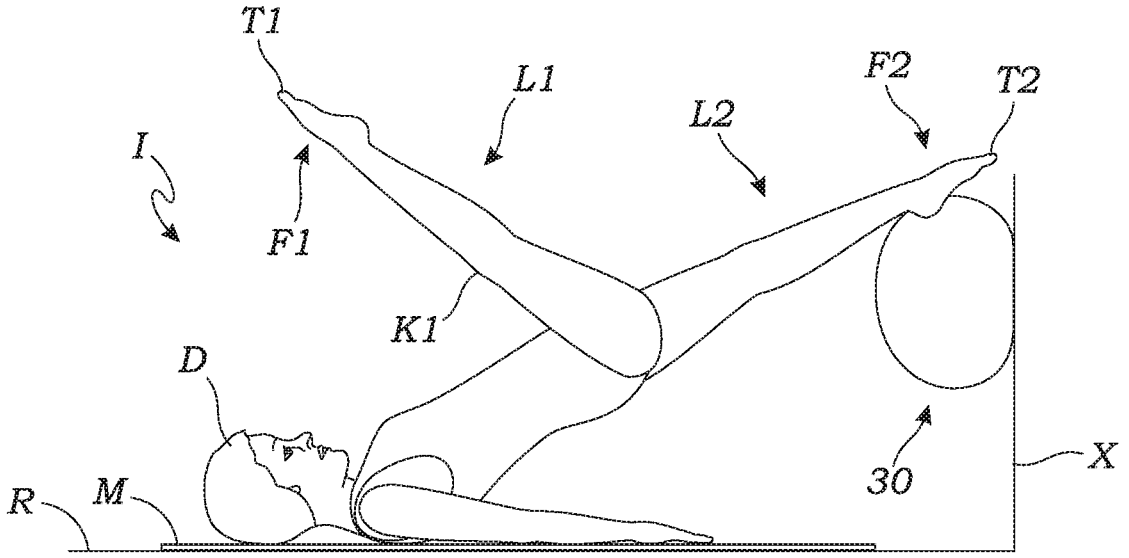
FIG. 6B illustrates a schematic perspective view thereof in a second position.

Turning now to FIGS. 6A and 6B, there are illustrated from the side still further ballet exercises similar to those of FIGS. 4 and 5. In fact, the starting position shown in FIG. 6A is the same as that of FIG. 5A—the "Sus-sous" position with the individual I still supine on the floor R and in a "Full Plank" position with her feet F1, F2 on the ball 30, as shown in FIGS. 5A and 6A, the feet F1, F2 crossed in a substantially tight leg position with toes T1, T2 pointed. Then, as shown in FIG. 6B, with the second leg L2 still supported on the ball 30, the first leg L1 while remaining straight with toes T1 pointed is brought overhead, with the knee K1 and foot F1 of the first or active leg L1 substantially directly above the head D. In classical ballet, this second exercise position of FIG. 6B is known as the "Grande Battement Devant" position. As above in connection with FIG. 5 and the movement between the "Sus-sous" and "Passe" positions, here the same is true in connection with the movement to and from the "Grande Battement Devant" position—the individual may hold each of the "Sus-sous" and "Grande Battement Devant" positions for a certain period of time and move slowly or rapidly from one to the other, depending on the particular fitness, training, or therapy goals for the individual I.

It will be appreciated by those skilled in the art that all such exercises as shown in FIGS. 1-6 can be mixed and ordered and arranged in a variety of ways or sequences beyond those shown and described without departing from the spirit and scope of the invention. It will be further appreciated that while a ball 30 has been shown and described as the unstable support apparatus 20 in connection with the particular ballet exercises illustrated that other such unstable support apparatuses may be employed as well, including a roller 40 as employed in connection with the further exercises illustrated in FIGS. 7-15 as discussed further below. By way of example, the ball 30 depicted may be substantially spherical when in its "at rest" configuration having a nominal diameter of sixteen inches (16 in.). The ball 30 may be rubber and filled with air to a suitable pressure, which is typically the pressure required to get the ball to its nominal diameter or size. In the illustrated embodiment, the group of exercises represented by FIGS. 1-6 may be performed over the course of approximately one hour, with a fifteen minute warm-up routine employing the exercises illustrated in FIGS. 1-3 and approximately forty-five minutes devoted to the exercises of FIGS. 4-6, such as by performing four sets of each exercise, on each side of the body where applicable (that is, with the left leg as the support leg and the right leg as the active or working leg and alternatively with the right leg as the support leg and the left leg as the active or working leg), holding each isometric or performing each exercise for approximately two to four minutes. Once again, other routines and combinations and durations of each exercise are possible, such that the above-described one-hour work-out routine is to be understood as merely illustrative.

Referring now to FIGS. 7-15, there are shown a variety of additional ballet exercises that may advantageously be performed on an unstable support apparatus 20, here a roller 40. In this further exemplary context, and for purposes of illustration and not limitation, the roller 40 may be a solid foam roller having a nominal approximately six inch (6 in.) diameter and length of approximately thirty-six inches (36 in.). Once more, it will be appreciated that a variety of other unstable support apparatus configurations are possible, including various sizes, shapes, and materials of construction and specifically a ball 30 as in FIGS. 1-6.

Figure 7:
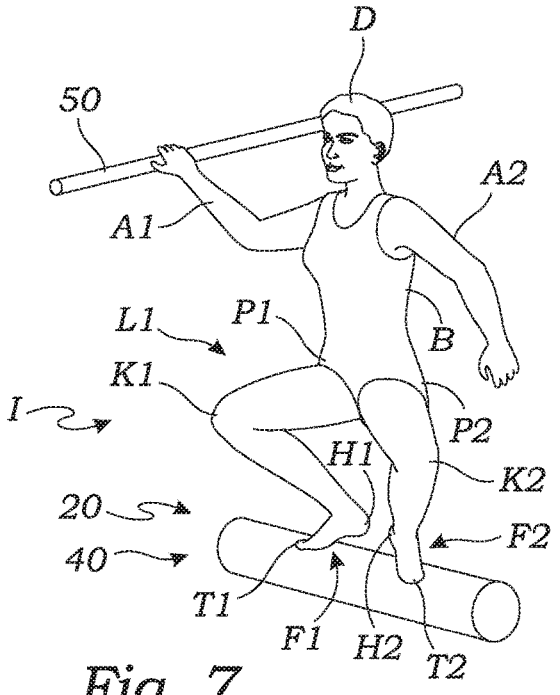
FIG. 7 illustrates a schematic perspective view of a first exercise involving a roller.

Referring first to FIG. 7, there is illustrated in perspective view an individual I standing on a roller 40 in a first ballet exercise position. Specifically, the individual I is in the first ballet foot position where both feet F1, F2 are positioned on the roller 40 so as to be in a substantially vertical or upright position thereon. The toes T1, T2 and hips P1, P2 are turned out so that the heels H1, H2 are in proximity. The arms A1, A2 may be at a comfortable position by the side or, as illustrated, at least one arm A1 may be in contact with an adjacent ballet barre 50 for balance and stability as the exercise is performed, as by grasping the barre 50. While the barre 50 is shown for simplicity as "floating" or not mounted in any particular manner, it will be appreciated that the barre 50 would be substantially rigidly mounted in a substantially horizontal arrangement and at an appropriate height employing any appropriate technique now known or later developed, the barre 50 particularly being either wall-mounted or floor-mounted or free-standing. As illustrated, where a roller 40 is employed, it is positioned substantially perpendicular to the ballet barre 50 for the present exercise. The ballet exercise involves bending the knees K1, K2 while balancing on the roller 40, first to a half position, known in classical ballet as "Demi Plie," and then to the deep position as shown in FIG. 7, known as "Grand Plie," wherein the back B and head D are vertically aligned over the feet F1, F2, and the roller 40 and the heels H1, H2 are raised out of contact with the roller 40, described as the "Grande Plie in First Position." Particularly, the legs L1, L2 are substantially directly above and in line with the toes T1, T2. It will be appreciated that in maintaining this position on an unstable support apparatus 20 such as the illustrated foam roller 40 the individual I must closely control muscle movement or contraction as in an isometric or static body position, thereby strengthening or conditioning the affected muscles, ligaments and tendons and improving balance.

Figure 8:
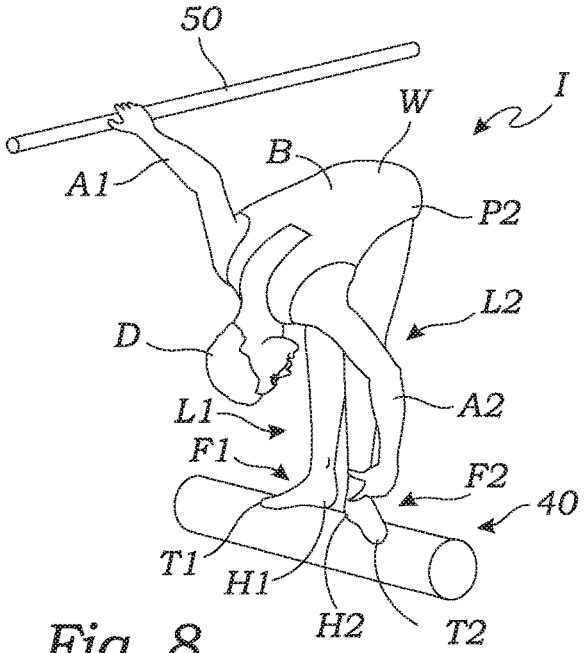
FIG. 8 illustrates a schematic perspective view of a second exercise involving a roller.

Turning to FIG. 8, there is shown a perspective view similar to FIG. 7 illustrating a "Cambre Devant" ballet exercise position wherein the individual I bends at the waist W, here performed on the roller 40 in a manner somewhat analogous to the exercise illustrated in FIG. 3 performed on the ball 30. That is, in FIG. 7 there is shown a further exercise position wherein the legs L1, L2 are straightened and the individual I bends at the waist W bringing the head D toward the feet F1, F2 again all while balancing on the roller 40. The toes T1, T2 and hips P1, P2 remain turned out with the heels H1, H2 in close proximity. Once more, the right arm A1 may be in contact with the adjacent ballet barre 50 for balance and stability as the exercise is performed.

Figure 9:
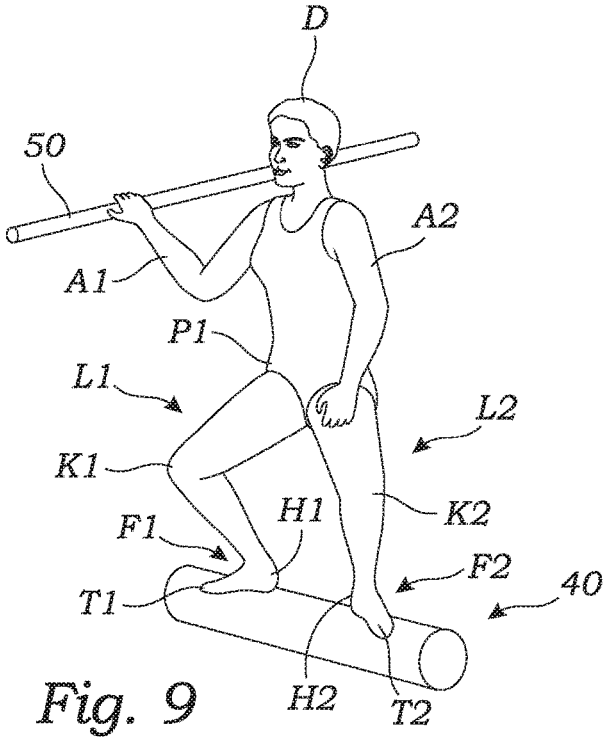
FIG. 9 illustrates a schematic perspective view of a third exercise involving a roller.

In FIG. 9 there is illustrated in perspective a "Demi and Grande Plie" ballet exercise in a "Second Position" as again performed while the individual I is positioned on the roller 40. Here, the feet F1, F2 are slid further apart—approximately shoulder width—with the toes T1, T2 and hips P1, P2 again turned out. Then the knees K1, K2 are again bent, first to the "Demi Plie" half position as shown in FIG. 9 and then to the "Grand Plie" deep position, wherein in both positions the back B and head D are again vertically aligned over the feet F1, F2, and the roller 40, though here the heels H1, H2 remain at substantially all times in contact with the roller 40, described as the "Grande Plie in Second Position." Once more, the arms A1, A2 may be at a comfortable position by the side or, as illustrated, one arm A1 may be in contact with the adjacent ballet barre 50 for balance and stability as the exercise is performed, as by grasping the barre 50.

In one exemplary exercise system and method according to aspects of the present invention, the first three "roller" ballet exercises illustrated in FIGS. 7-9 are part of a "warm-up" typically done at the ballet barre 50 for on the order of fifteen minutes. Though not shown, as the individual I becomes stronger or more skilled, she may be able to perform such exercises on an unstable support apparatus 20 such as a ball 30 or roller 40 unaided (without contacting or grasping the barre 50).

Figure 10A:
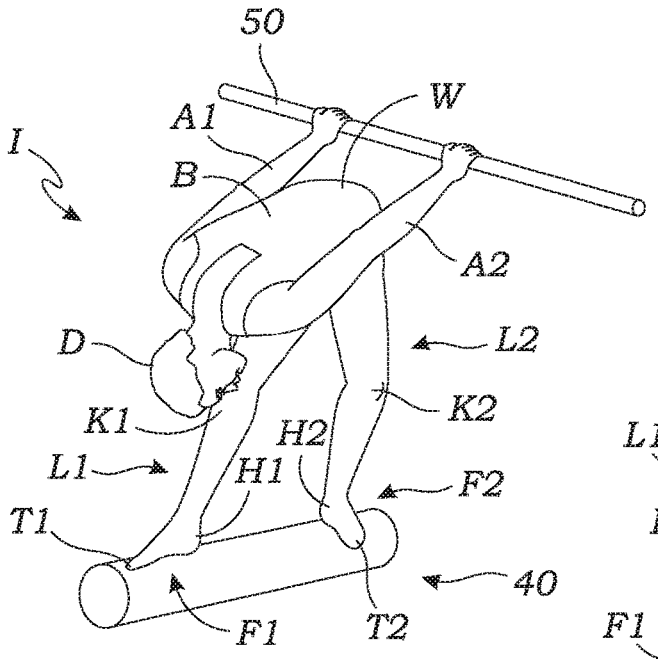
FIG. 10A illustrates a schematic perspective view of a fourth exercise involving a roller, in a first position.
Figure 10B:
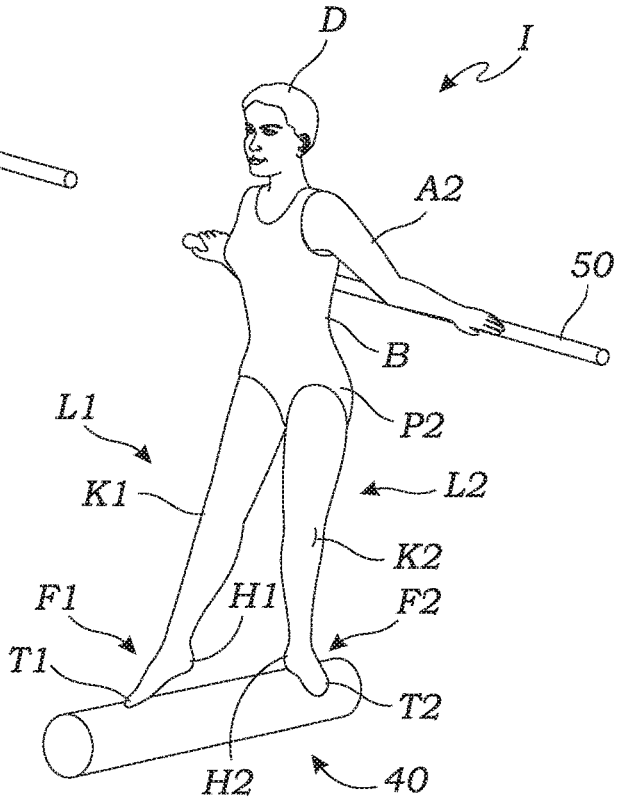
FIG. 10B illustrates a schematic perspective view thereof in a second position.
Figure 10C:
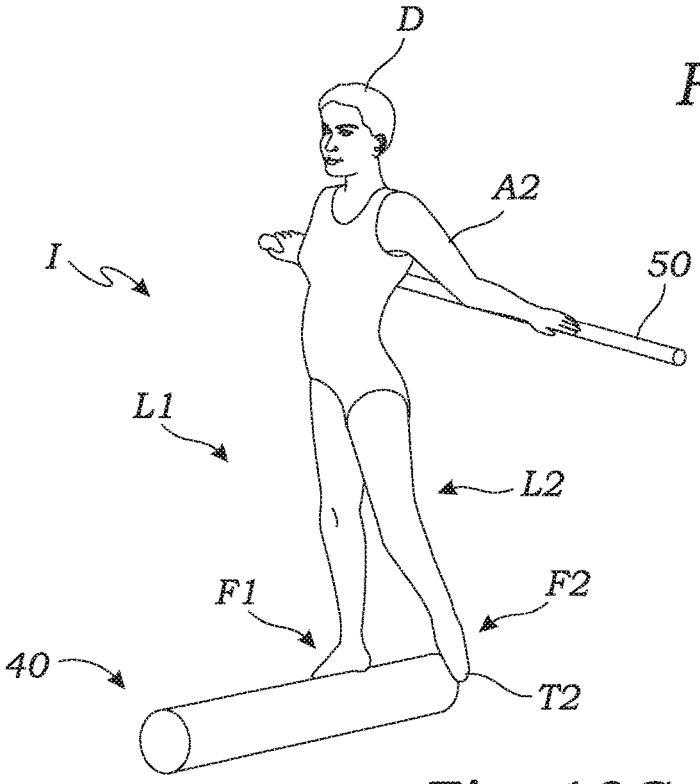
FIG. 10C illustrates a schematic perspective view thereof in a third position.

Turning to FIGS. 10A-10C, there are shown perspective views illustrating still further ballet exercises performed while effectively standing on a roller 40 that is adjacent a ballet barre 50, here still substantially perpendicular thereto. First, as illustrated in FIG. 10A, the feet F1, F2 are positioned on the roller 40 substantially in-line in a spaced-apart somewhat heel-to-toe arrangement, the leg L1 furthest from the ballet barre 50 defining the forward leg and the leg L2 closest to the ballet barre 50 defining the rear leg. As illustrated, the foot F1 of the forward leg L1, in the illustrated exercise the right leg, is substantially parallel to the roller 40 with toes T1 pointed therealong, while the foot F2 of the rear or left leg L2 is substantially perpendicular to the roller 40, with the hip P2 and toes T2 in classical turn-out position. In such position the individual I has her back B to the ballet barre 50 and grasps the ballet barre 50 for stability and to stretch the arms A1, A2 as the individual I then bends deeply at the waist W bringing the head D adjacent the knee K1 of the forward leg L1 in a modified "Cambre Devant" position. In order to reach and hold such ballet exercise position, while the forward leg L1 is kept substantially straight, the rear leg L2 is bent slightly at the knee K2. As illustrated in FIG. 10B, the individual I may then straighten at the waist W with the back B and head D somewhat aligned over the rear leg L2, which is also straightened at the knee K2 is effectively the support or weight-bearing leg, while the front leg L1 remains straightened with toes T1 pointed and just touching the roller 40, but with the heel H1 raised off of the roller 40 in a classical "Temps Lie" position, the front leg L1 thus being the active leg in this exercise. In shifting to this exercise, it will be appreciated that the hands that were initially approximately shoulder width apart may be slid along the ballet barre 50 to be further apart as the individual I straightens up. Next, as illustrated in FIG. 10C, the individual I shifts the forward foot F1 and leg L1 rearwardly until substantially beneath the head D so as to now become the support leg, while the rear leg L2 is also shifted rearwardly into a classic "Tendu Derriere" position with the rear leg L2 as the active leg having the foot F2 hanging off the rear end of the roller 40 with toes T2 pointed. It will be appreciated that the three illustrated ballet exercises of FIGS. 10A-10C can be performed in any order and combination, alone or with other exercises such as "Demi Plie" and "Grande Plie," for example.

Figure 11:
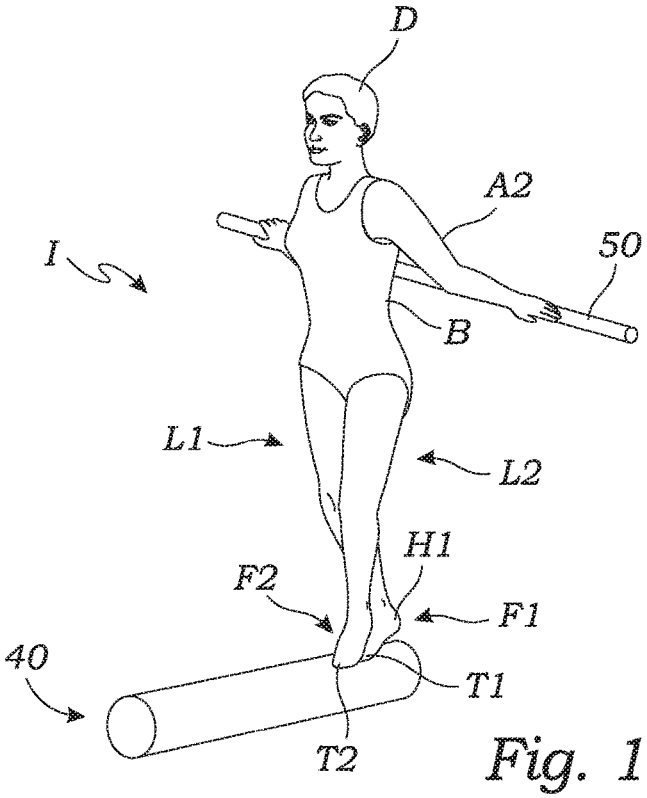
FIG. 11 illustrates a schematic perspective view of a fifth exercise involving a roller.

As a further exemplary ballet exercise position with the roller 40 still adjacent to and substantially perpendicular to the ballet barre 50, as illustrated in FIG. 11, the individual I may bring the forward and rear legs L1, L2 together and cross the feet F1, F2 in a tight leg position, with the toes T1, T2 of both feet F1, F2 pointed, thus in a classical "Sus-sous" ballet position while balancing on the roller 40. Once more, while the illustrated exercises are shown with the individual I contacting the ballet barre 50 for balance and stability, with the requisite skill and training any such exercises may also be performed even on an unstable support apparatus 20 like a ball 30 or roller 40 unaided. Again, any such isometric exercises as shown in FIGS. 10 and 11 may be performed on any unstable support beyond the roller 40 illustrated, including but not limited to a ball 30 such as illustrated in FIGS. 1-6. And any such exercises can be combined with any of those illustrated herein and others to yield the desired exercise system and method.

Figure 12A:
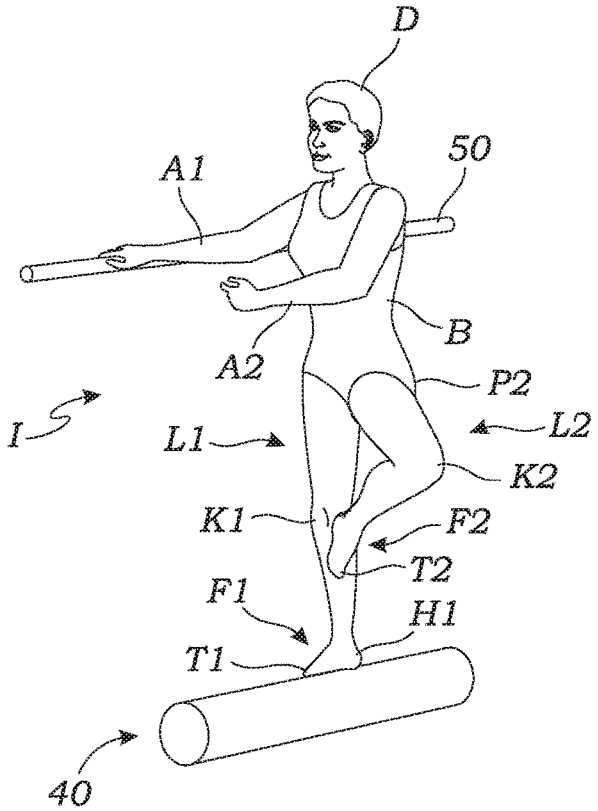
FIG. 12A illustrates a schematic perspective view of a sixth exercise involving a roller, in a first position.
Figure 12B:
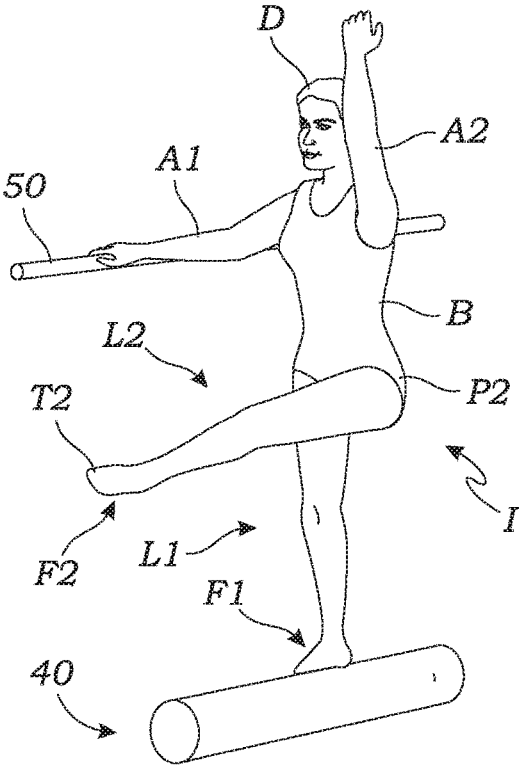
FIG. 12B illustrates a schematic perspective view thereof in a second position.

Turning now to FIGS. 12A and 12B, there are illustrated again in perspective view two further exemplary isometric ballet exercises advantageously performed on an unstable support apparatus 20 such as a roller 40, here with the roller 40 substantially parallel to an adjacent ballet barre 50. With the equipment so arranged, the individual I stands on the roller 40 while selectively contacting the ballet barre 50 for balance as needed. First, as shown in FIG. 12A, the individual places one foot F1, here the right foot, on the roller 40, the associated first leg L1 thus being the support leg in this exercise, while the foot F2 of the other leg L2, here the left leg and hence the active leg, is brought adjacent to the knee K1 of the support leg L1, with both legs L1, L2 and thus toes T1, T2 and hips P1, P2 in the classical ballet "turn-out" position, particularly the active leg L2, which exercise is generally referred to in classical ballet parlance as "Passe from Fifth Position." Next, as shown in FIG. 12B, the working or active leg L2 "unfolds" and is extended straight out in a forward direction with toes T2 pointed, the active leg L2 being substantially horizontal and the support leg L1 being substantially vertical in this so-called "Developpe Devant" ballet position. It will be appreciated that in both illustrated exercises the overall body position remains generally constant, with the back B straight and head D vertically substantially aligned over the support leg L1 and foot F1. In the first position shown in FIG. 12A the free arm A2, versus the arm A1 that is selectively in contact with the ballet barre 50, is held in the "First Position" across the chest, while in the "Developpe Devant" position the free arm A2 is raised to the "Fifth En Haut" position substantially overhead. It will be appreciated that a variety of arm positions and overall body positions are possible according to aspects of the present invention such that the illustrated positions are merely exemplary.

Figure 13A:
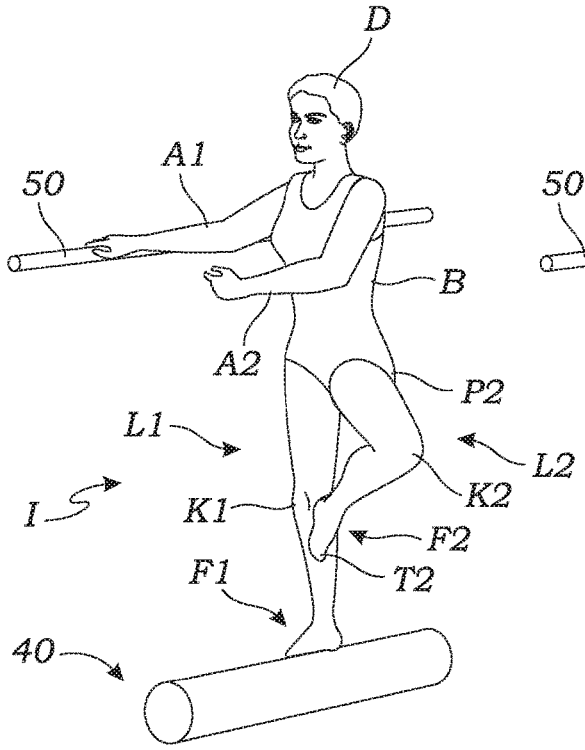
FIG. 13A illustrates a schematic perspective view of a seventh exercise involving a roller, in a first position.
Figure 13B:
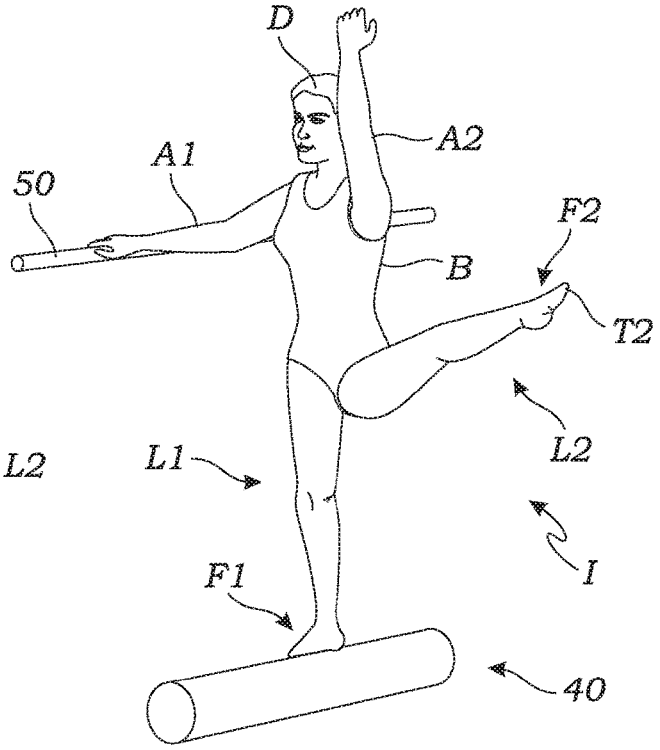
FIG. 13B illustrates a schematic perspective view thereof in a second position.

Referring next to the perspective illustrations of FIGS. 13A and 13B, first the individual I starts in the same "Passe from Fifth Position" as illustrated in FIG. 12A, with the foot F2 of the working or active leg L2 brought adjacent to the knee K1 of the support leg L1. Then, as shown in FIG. 13B, the individual I extends the active leg L2 straight out in a lateral direction with toes T2 pointed, the active leg L2 being substantially horizontal and the support leg L1 being substantially vertical, still with the back B straight and the head D substantially vertically aligned over the active leg L1 and foot F1, which position is often termed "Developpe Passe in the Second Position." Once again, in the Second Position the arm A2 is raised to the "Fifth En Haut" position.

Figure 14:
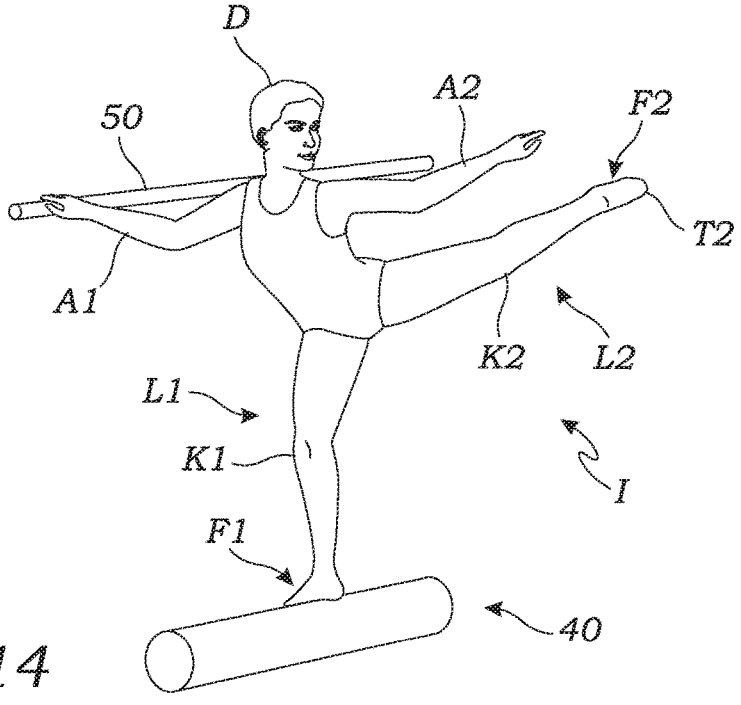
FIG. 14 illustrates a schematic perspective view of an eighth exercise involving a roller.

In FIG. 14, there is illustrated a still further exemplary ballet exercise position with the roller 40 substantially parallel to an adjacent ballet barre 50 and one foot F1 on the roller 40, such that the associated leg L1 is again the support leg. Here, the individual I extends the active leg L2 straight out in a rearward direction with toes T2 pointed, the active leg L2 being substantially horizontal and the support leg L1 being substantially vertical, though here with the support leg L1 slightly bent at the knee K1 gracefully. It will be appreciated that the classical ballet name for this exercise position is "Fondue Arabesque," with "fondue" meaning "to melt," with reference to the lowering of the body with the bending of the knee K1 of the support leg L1, while the active leg L2 is in "arabesque" or "straight" position. The free arm A2 is shown in the "Allonge Derriere" or "along behind" position, following the active leg L2. Those skilled in the art will again appreciate that all such ballet exercises can be combined in various ways and sequences and be performed on a variety of unstable supports, including the illustrated roller 40 and the ball 30, in accordance with aspects of the present invention.

Figure 15A:
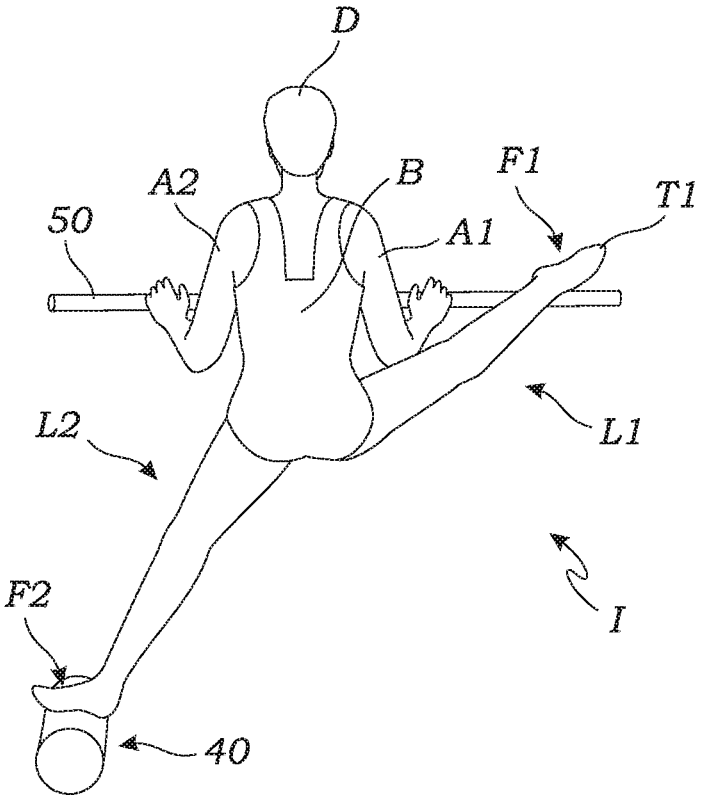
FIG. 15A illustrates a schematic perspective view of a ninth exercise involving a roller, in a first position.
Figure 15B:
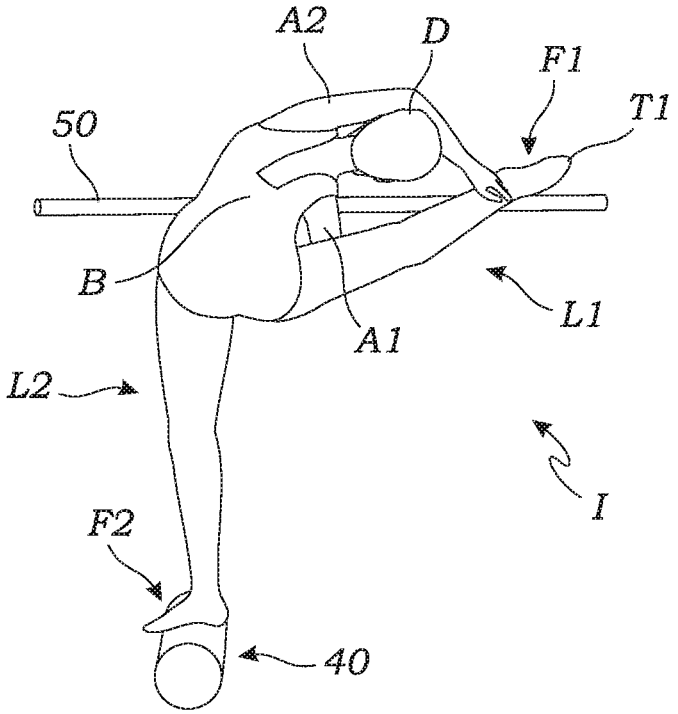
FIG. 15B illustrates a schematic perspective view thereof in a second position.

Finally, with reference to the exercises illustrated in FIGS. 15A and 15B, it is first noted that the roller 40 is again positioned adjacent and substantially perpendicular to the ballet barre 50 just as in FIGS. 7-11, only now rather than having the side to the barre 50 (FIGS. 7-9) or back to the barre 50 (FIGS. 10 and 11), here the individual I is facing the ballet barre 50. Once more, only one foot is placed on the roller 40, here the left or second foot F2, defining the second leg L2 as the support leg. The first leg L1 or working or active leg is placed on the ballet barre 50 for support in a so-called "Second Position" stretch with the foot F1 and toes T1 pointed. The individual may contact or grasp the barre 50 for further stability as all the weight is borne on the support leg L2, particularly when sliding along the barre 50 to a deeper stretch position wherein the weight of the individual I and the back B and head D, though substantially vertically aligned with each other, are no longer vertically aligned with or over the support leg L1 and foot F1 on the roller 40. In this way the support leg L2 is substantially inclined in the direction of the active leg L1 while the torso is substantially vertical. In an alternative "Second Position" stretch as shown in FIG. 15B, the support leg L2 is substantially vertical over the roller 40, and now the individual I bends her back B such that her head D is brought near to the active leg L1 and barre 50, whereby the torso is substantially inclined in the direction of the active leg L1. It will be appreciated that the two stretches illustrated in FIGS. 15A and 15B may be performed in any order and combined with other stretches and exercises according to aspects of the present specification.

Although illustrated using roller 40, the ballet exercised positions depicted in FIGS. 7-15 can be performed on any unstable support apparatus disclosed herein, including ball 30 and a rotational disc.

Those skilled in the art will appreciate that all such exercises as shown in FIGS. 7-15, just as with FIGS. 1-6, can be mixed and ordered and arranged in a variety of ways or sequences beyond those shown and described without departing from the spirit and scope of the invention; in fact, the exercises of FIGS. 1-6 may be combined with those of FIGS. 7-15 in arriving at a comprehensive exercise system and method, and whether all exercises are performed on a ball 30 as the unstable support apparatus 20, a roller 40, or some combination of the two. Any such exercises may again be performed at and in selective contact with the ballet barre 50 or unaided or may even be performed laying supine (face up) on the floor. It will be further expressly appreciated that while a roller 40 has been shown and described as the unstable support apparatus 20 in connection with the particular ballet exercises illustrated in FIGS. 7-15 that other such unstable support apparatuses may be employed as well, including a ball 30 as employed in connection with the exercises illustrated in FIGS. 1-6 as discussed above. In the illustrated embodiment, the group of exercises represented by FIGS. 7-15 may be performed over the course of approximately one hour, with a fifteen minute warm-up routine employing the exercises illustrated in FIGS. 7-9 and approximately forty-five minutes devoted to the exercises of FIGS. 10-15, such as by performing four sets of each exercise, two on each side of the body where applicable (that is, with the left leg as the support leg and the right leg as the active or working leg and alternatively with the right leg as the support leg and the left leg as the active or working leg), holding each isometric or performing each exercise for approximately two to four minutes. Once again, other routines and combinations and durations of each exercise are possible, such that the above-described one-hour work-out routine is to be understood as merely illustrative.

Roller Exercise #1—Demi and Grande Plies in First Position: This exercise demands additional spine erector activation, pelvic stability, and thoracic postural control to maintain appropriate alignment and balance in sagittal plane. It also requires more proprioceptive control during eccentric quad activation with plié movement. It further demands additional hip external rotation and well-aligned turnout to provide a balanced base prior to movement into plié. The dancer is not able to perform this movement on a foam roller correctly if turnout is achieved with inappropriate lordosis. The use of the foam roller demands that turnout is achieved through correct hip range of motion, otherwise proper alignment is not created and the dancer is not able to maintain proper balance.

Roller Exercise #2—Cambre Devant in First Position: This exercise requires similar demands as Exercise #1 with additional hip external rotation and well-aligned turnout to provide a balanced base. This creates a "subfloor" for greater stretch into cambré devant position.

Roller Exercise #3—Demi and Grande Plié in Second Position: This exercise demands additional postural alignment via maximal hip external rotation activation, spinal erector and core muscle stabilization, posterior pelvic tilt, and thoracic postural control, in sagittal plane. This also requires hip abduction and external control in sequence with foot stability to ensure appropriate knee and ankle alignment. The dancer is unable to perform this maneuver on a foam roller with excessive lordosis, foot winging, or thoracic malpositioning.

Roller Exercise #4—Demi/Grande Plié, Fourth Position, Cambre Devant & Temps Lie to Tendu Derriere: In this exercise, weight is transferred front to back, while maintaining side to side stability, which demands additional hip stability from opposing adduction/abduction activation. Proprioceptive awareness is increased via the unstable base. Weight transfer into tendu derriere on the foam roller requires activation of coronal plane spine stability while the spine is in an extended position, a very unique spine stability exercise. In the fourth position on foam roller, more is demanded of ankle stability via activation of peroneal, tibialis, and mid-foot musculature.

Roller Exercise #5—Demi/Grande Plié, Fifth Position, with Sous-sus to $5^{th}$ Position Releve': This exercise demands additional thoracic and upper kinetic chain alignment to maintain alignment in coronal plane to avoid rolling off the foam roller. Additionally, this postural control is essential during sous-sus transition. Coronal plane stability in plié is achieved via additional hip abduction and external rotation activation.

Roller Single Leg Exercises—During single leg exercises, there is a separation between the working leg and the base leg. The present method and technique is unique compared to traditional ballet training in how the base leg is utilized. In traditional ballet training, the base leg is static on a stable surface, which places the focus mostly on the working leg. With the present method, the base leg is dynamic on an unstable surface, requiring additional stabilization throughout the whole kinetic chain. The dynamic nature of the base leg requires additional hip and foot stability.

Roller Exercise #6—Passé from $5^{th}$ Position to Developpe Devant: This exercise demands additional base leg stability in coronal plane via opposing hip abduction/adduction activation, while working leg transitions from hip abduction/knee flexion to hip flexion/knee extension. The unstable support for the base leg demands that external rotation via gluteus activation is paired with additional hip abduction stabilization.

Roller Exercise #7—Developpe Passé a la Seconde from Fifth Position: This exercise requires similar demands as Exercise #6, but with movement a la seconde there is an even greater demand on coronal plane stabilization.

Roller Exercise #8—Fondue Arabesque: Performing a fondue maneuver on an unstable surface requires a greater demand for hip stability during eccentric quadriceps contraction. With the knee in flexed position, knee & foot alignment becomes more of a challenge, requiring appropriate biomechanical balance of hip abduction and external rotation.

Roller Exercise #9—Barre Stretch in Seconde Position: The unstable base leg creates a demand for base leg hip stability, in particular hip adduction, while allowing for passive working leg stretch. This translates well to dance participation, which is a dynamic balance of passive and active joint range of motion. The foam roller provides a unique opportunity to develop this delicate balance.

The first and second positions are considered the most stable positions in the coronal plane, while fourth and fifth positions establish stability in the sagittal plane. Conversely, first and second positions are inherently unstable in the sagittal plane, while fourth and fifth positions are inherently unstable in the coronal plane. The use of the foam roller highlights these inherent instabilities and forces the dancer to develop maximal muscle activation to appropriately compensate. This translates to greater performance on the traditional dance floor.

Ball Exercise #1—Standing in First Position: Appropriate turnout in first position should be achieved by an adequate amount of hip external rotation. Dancers with inadequate hip external rotation, "cheat" by turning through the knees, collapsing into the foot, or arching in the back. When using a ball, the dancer is able to maintain balance in first position only if the turnout is achieved in a hip-dominate way. If the dancer "cheats", they will not be able to maintain proper alignment and therefore will not be able to maintain balance. Thus, the ball demands proper alignment and hip turnout. The compliant nature of the plastic ball will also accentuate a lack of foot stability and therefore expose this flaw and direct future intervention.

Ball Exercise #2—Grande Plié in First Position: Performance on a ball demands precise hip/ankle/foot alignment to maintain balance. This precise alignment is maintained by recruitment of core, hip, and foot stability. Additionally, a plié is achieved on a traditional flat surface through isolated quadriceps eccentric control. Achievement of a plié on a plastic ball requires stability in all planes while performing a quadriceps eccentric contraction. Multiplane stabilization demands maximal hip/core/foot muscle activation.

Ball Exercise #3—Cambre Forward in First Position: This exercise demands a baseline of stability achieved in exercise #1 with additional sagittal plane balance control compared to a traditional stable floor surface. In order to achieve additional sagittal plane balance on a ball, while performing cambré forward, additional foot and ankle proprioceptive control is required.

Ball Exercise #4—Demi Plié in Neutral Moving to First Position Plank: This exercise provides a classic bridge/plank gluteus activation, while allowing the dancer to move through dance-specific positions. The use of a ball allows this three step progression, promoting progressive movements of hip external rotation and abduction to core and gluteus muscle activation to hip and knee extension.

Ball Exercise #5—Passé Position from Sous-sus: By changing the ballet "floor" to a mobile plastic ball, you introduce an unstable support. This exercise facilitates the increased amount of stability training noted in exercise 4, but has additional demands unique to using a single limb on an unstable surface. The activation of hip extension and external rotation against the unstable plastic ball demands the recruitment of rotational spine stability. In traditional ballet training, it is difficult to isolate rotational spine stability. This exercise is unique in its ability to integrate spine stability training in a rotational plane with dance-specific movements.

Ball Exercise #6—Grande Battement Devant from Sous-sus: In traditional ballet training, done on a stable floor, the grande battement movement requires concentric hip flexion of the working leg pared with base leg hip stability in mostly a sagittal plane. Performing the grande battement movement from sous-sus inverted and with the base leg on an unstable surface creates multiple unique demands. As mentioned for exercise #5, the plastic ball single limb positioning requires activation of spine stability in a rotational plane. Additionally, in order to move the working leg into a battement devant position, the dancer needs to apply a counterforce to the ball on the wall. This activates a level of hip extension and kinetic chain lengthening not seen in other traditional methods and translates into greater lift during dance-specific movements. Also of note is the unique effect inversion has on the dancers' performance of a battement devant. During traditional training the lifting of the leg requires a concentric movement of the anterior chain (hip flexion, core activation) and an opposing force of eccentric stability in the posterior chain. By inverting the dancer, the muscle activation is reversed. This provides a unique opportunity to work opposing muscle groups for greater overall training, hip stability, and balanced mechanics.

Aspects of the present specification may also be described as follows:

1. An exercise system comprising a ballet barre; and an unstable support apparatus, wherein an individual may support a limb on the unstable support apparatus and selectively contact the ballet barre for balance while performing a ballet exercise.
2. The exercise system of embodiment 1, wherein the unstable support apparatus is a ball.
3. The exercise system of embodiment 1, wherein the unstable support apparatus is a roller.
4. The exercise system of embodiments 1-3, wherein the unstable support apparatus is solid foam.
5. The exercise system of embodiments 1-3, wherein the unstable support apparatus is foam-filled.
6. The exercise system of embodiments 1-3, wherein the unstable support apparatus is inflatable.
7. The exercise system of any one of the embodiments 1-3, wherein the unstable support apparatus is gas-filled.
8. The exercise system of any one of the embodiments 1-3, wherein the unstable support apparatus is gel-filled.
9. The exercise system of any of the embodiments 1-3, wherein the unstable support apparatus is liquid-filled.
10. The exercise system of any one of the embodiments 1 or 2, wherein the unstable support apparatus is substantially spherical.
11. The exercise system of any one of the embodiments 1 or 3, wherein the unstable support apparatus is substantially cylindrical.
12. The exercise system of any one of the embodiments 1-11, wherein the unstable support apparatus has a volume in the range of 40 $in^3$ to 25,000 $in^3$.
13. The exercise system of any one of the embodiments 1-12, wherein the unstable support apparatus has a surface area in the range of 40 $in^2$ to 4,000 $in^2$.
14. The exercise system of any one of the embodiments 1-13, wherein the unstable support apparatus has a primary dimension in the range of 2 in to 48 in.
15. The exercise system of any one of the embodiments 1-14, wherein the unstable support apparatus is non-rigid.
16. The exercise system of any one of the embodiments 1-15, wherein the unstable support apparatus is curved.
17. The exercise system of any one of the embodiments 1-16, wherein the unstable support apparatus is conformable.
18. The exercise system of any one of the embodiments 1-17, wherein the unstable support apparatus is capable of rolling.
19. The exercise system of any one of the embodiments 1-18, wherein the ballet barre is wall-mounted.
20. The exercise system of any one of the embodiments 1-18, wherein the ballet barre is floor-mounted.
21. The exercise system of any one of the embodiments 1-18, wherein the ballet barre is free-standing.
22. A method of employing the exercise system of any one of the embodiments 1-21, the method comprising the steps of positioning at least one limb on the unstable support apparatus; and simultaneously performing a ballet exercise.
23. The method according to embodiment 22, wherein the at least one limb comprises both feet, with the feet positioned on the unstable support apparatus.

24. The method according to embodiments 22 or 23, wherein the ballet exercise comprises turning the toes and hips out so that the heels are in proximity.
25. The method according to any one of the embodiments 22-24, wherein the ballet exercise further comprises raising the arms overhead in a relatively high, substantially oval shape.
26. The method according to any one of the embodiments 22-25, wherein the ballet exercise further comprises bending the knees deeply.
27. The method according to embodiment 26, wherein the ballet exercise further comprises elevating the heels off of the unstable support apparatus.
28. The method according to embodiment 26, wherein the ballet exercise further comprises maintaining the heels in contact with the unstable support apparatus.
29. The method according to any one of the embodiments 22-28, wherein the ballet exercise further comprises bending at the waist with legs substantially straight.
30. The method according to any one of the embodiments 22-29, wherein the unstable support apparatus comprises a ball.
31. The method according to any one of the embodiments 22-29, wherein the unstable support apparatus comprises a roller.
32. The method according to any one of the embodiments 22-31, wherein the individual contacts the ballet barre for balance.
33. The method according to any one of the embodiments 22-24, wherein the ballet exercise further comprises bending at the waist with legs substantially straight and wrapping both arms around the legs.
34. The method according to any one of the embodiments 22-24, wherein the ballet exercise further comprises the individual laying supine on a floor with the unstable support apparatus positioned on an adjacent wall, with knees bent as the feet are in contact with the unstable support apparatus so as to hold it in position on the wall.
35. The method according to embodiment 34, wherein the ballet exercise further comprises lifting the hips away from the floor and into a plank position such that only the upper back, head and arms of the individual remain in contact with the floor.
36. The method according to embodiment 35, wherein the ballet exercise further comprises shifting the feet on the unstable support apparatus as the legs are straightened into a full plank position with toes pointed.
37. The method according to embodiment 36, wherein the ballet exercise further comprises crossing the feet in a tight leg position.
38. The method according to embodiments 36 or claim 37, wherein the ballet exercise further comprises bringing the foot of one leg into proximity with the knee of the other leg, the leg still in contact with the unstable support apparatus defining the support leg and the other leg defining the active leg, the toes of both the active and support legs remaining pointed and the foot of the active leg being adjacent the knee of the support leg.
39. The method according to embodiments 36 or claim 37, wherein the ballet exercise further comprises bringing the foot of one leg overhead, the leg still in contact with the unstable support apparatus defining the support leg and the other leg defining the active leg, the toes of both the active and support legs remaining pointed and the foot of the active leg being brought overhead in substantially the same vertical plane as the support leg such that the individual is performing a front split in the plank position.
40. The method according to any one of embodiments 33-39, wherein the unstable support apparatus comprises a ball.
41. The method according to any one of embodiments 33-39, wherein the unstable support apparatus comprises a roller.
42. The method according to embodiment 23, wherein the feet are positioned on the unstable support apparatus substantially in-line in a spaced-apart somewhat heel-to-toe arrangement, the leg furthest from the ballet barre defining the forward leg and the leg closest to the ballet barre defining the rear leg.
43. The method according to embodiment 42, wherein the ballet exercise comprises: positioning the unstable support apparatus adjacent to the ballet barre; orienting the back of the individual toward the ballet barre; and contacting the ballet barre for balance.
44. The method according to embodiment 43, wherein the ballet exercise further comprises reaching behind the individual to grasp the ballet barre with two hands substantially shoulder-width apart; and bending at the waist so as to bring the head in proximity to the knee of the forward leg.
45. The method according to embodiments 43 or claim 44, wherein the ballet exercise further comprises straightening at the waist while sliding the hands apart along the ballet barre; and pointing the toes of the foot of the forward leg, wherein the weight of the individual is primarily borne on the rear leg, the forward leg defining the active leg and the rear leg defining the support leg.
46. The method according to any one of embodiments 43-45, wherein the ballet exercise further comprises sliding the forward leg rearwardly; shifting the weight of the individual to the forward leg; and pointing the toes of the foot of the rear leg, the forward leg defining the support leg and the rear leg defining the active leg.
47. The method according to any one of embodiments 43-46, wherein the ballet exercise further comprises bringing the forward and rear legs together and crossing the feet in a tight leg position, with the toes of both feet pointed.
48. The method according to any one of embodiments 42-47, wherein the unstable support apparatus comprises a ball.
49. The method according to any one of embodiments 42-47, wherein the unstable support apparatus comprises a roller; and the roller is substantially perpendicular to the ballet barre.
50. The method according to embodiments 22, wherein the at least one limb comprises a first foot positioned on the unstable support apparatus, the leg of the first foot defining the support leg; and a second foot is not in contact with the unstable support apparatus, the leg of the second foot defining the active leg.
51. The method according to embodiments 50, wherein the ballet exercise further comprises: standing on the unstable support apparatus on the support leg; and placing the second foot adjacent to the knee of the support leg, turning the active leg out at the hip.
52. The method according to embodiments 50 or 51, wherein the ballet exercise further comprises extending the active leg straight out in a forward direction with toes pointed, the active leg being substantially horizontal and the support leg being substantially vertical.
53. The method according to any one of embodiments 50-52, wherein the ballet exercise further comprises extending the active leg straight out in a lateral direction with toes pointed, the active leg being substantially horizontal and the support leg being substantially vertical.
54. The method according to any one of embodiments 50-53, wherein the ballet exercise further comprises extending the active leg straight out in a rearward direction with toes pointed, the active leg being substantially above horizontal and the support leg being substantially vertical.

55. The method according to any one of embodiments 50-54, wherein the unstable support apparatus comprises a ball.

56. The method according to any one of embodiments 50-55, wherein the unstable support apparatus comprises a roller; and the roller is substantially parallel to the ballet barre.

57. The method according to any one of embodiments 50-56, wherein the individual contacts the ballet barre for balance.

58. The method according to any one of embodiments 50-54, wherein the ballet exercise further comprises placing the second foot of the active leg on the ballet barre for support.

59. The method according to embodiment 58, wherein the support leg is substantially inclined in the direction of the active leg; and the torso is substantially vertical.

60. The method according to embodiment 58, wherein the support leg is substantially vertical; and the torso is substantially inclined in the direction of the active leg.

61. The method according to any one of embodiments 58-60, wherein the unstable support apparatus comprises a roller; and the roller is substantially perpendicular to the ballet barre.

62. A kit comprising an exercise system as defined in any one of embodiments 1-21.

63. The kit according to embodiment 62, further comprising as the unstable support apparatus both a ball and a roller.

64. The kit according to embodiment 63, further comprising instructional material, wherein the instructional material provides instructions on how to perform a method as defined in any one of embodiments 22-61.

65. Use of an exercise system as defined in any one of embodiments 1-22 for strength training.

66. Use of an exercise system as defined in any one of embodiments 1-22 for conditioning.

67. Use of an exercise system as defined in any one of embodiments 1-22 for increasing flexibility.

68. Use of an exercise system as defined in any one of embodiments 1-22 for improving balance.

69. Use of an exercise system as defined in any one of embodiments 1-22 for improving quickness.

70. Use of an exercise system as defined in any one of embodiments 1-22 for improving vertical leap.

71. Use of an exercise system as defined in any one of embodiments 1-22 for improving in dance performance.

72. Use of an exercise system as defined in any one of embodiments 1-22 for improving in running.

73. Use of an exercise system as defined in any one of embodiments 1-22 for reducing risk of injury.

74. Use of an exercise system as defined in any one of embodiments 1-22 for rehabilitating from injury.

75. Use of an exercise system as defined in embodiment 73 or embodiment 74, wherein the injury is selected from the group consisting of a strained muscle, a torn muscle, muscular imbalance, scoliosis, a strained ligament, a torn ligament, a strained tendon, a torn tendon, and a broken bone.

76. The use according to any one of embodiments 65-75, wherein the use comprises a method as defined in any one of embodiments 22-61.

77. An exercise method, comprising the steps of a) positioning at least one limb on an unstable support apparatus; and b) simultaneously performing a ballet exercise.

78. The method according to embodiment 77, wherein the at least one limb comprises both feet, with the feet positioned on the unstable support apparatus.

79. The method according to embodiments 77 or 78, wherein the ballet exercise comprises turning the toes and hips out so that the heels are in proximity.

80. The method according to any one of embodiments 77-79, wherein the ballet exercise further comprises raising the arms overhead in a relatively high, substantially oval shape.

81. The method according to any one of embodiments 77-80, wherein the ballet exercise further comprises bending the knees deeply.

82. The method according to embodiment 81, wherein the ballet exercise further comprises elevating the heels off of the unstable support apparatus.

83. The method according to embodiment 81, wherein the ballet exercise further comprises maintaining the heels in contact with the unstable support apparatus.

84. The method according to any one of embodiments 77-83, wherein the ballet exercise further comprises bending at the waist with legs substantially straight.

85. The method according to any one of embodiments 77-84, wherein the unstable support apparatus comprises a ball.

86. The method according to any one of embodiments 77-84, wherein the unstable support apparatus comprises a roller.

87. The method according to any one of embodiments 77-86, wherein the individual contacts the ballet barre for balance.

88. The method according to any one of embodiments 77-79, wherein the ballet exercise further comprises bending at the waist with legs substantially straight and wrapping both arms around the legs.

89. The method according to any one of embodiments 77-79, wherein the ballet exercise further comprises the individual laying supine on a floor with the unstable support apparatus positioned on an adjacent wall, with knees bent as the feet are in contact with the unstable support apparatus so as to hold it in position on the wall.

90. The method according to embodiment 89, wherein the ballet exercise further comprises lifting the hips away from the floor and into a plank position such that only the upper back, head and arms of the individual remain in contact with the floor.

91. The method according to embodiment 90, wherein the ballet exercise further comprises shifting the feet on the unstable support apparatus as the legs are straightened into a full plank position with toes pointed.

92. The method according to embodiment 91, wherein the ballet exercise further comprises crossing the feet in a tight leg position.

93. The method according to embodiments 91 or 92, wherein the ballet exercise further comprises bringing the foot of one leg into proximity with the knee of the other leg, the leg still in contact with the unstable support apparatus defining the support leg and the other leg defining the active leg, the toes of both the active and support legs remaining pointed and the foot of the active leg being adjacent the knee of the support leg.

94. The method according to embodiments 91 or 92, wherein the ballet exercise further comprises bringing the foot of one leg overhead, the leg still in contact with the unstable support apparatus defining the support leg and the other leg defining the active leg, the toes of both the active and support legs remaining pointed and the foot of the active leg being brought overhead in substantially the same vertical plane as the support leg such that the individual is performing a front split in the plank position.

95. The method according to any one of embodiments 88-94, wherein the unstable support apparatus comprises a ball.

96. The method according to any one of embodiments 88-95, wherein the unstable support apparatus comprises a roller.

97. The method according to embodiment 78, wherein the feet are positioned on the unstable support apparatus substantially in-line in a spaced-apart somewhat heel-to-toe arrangement, the leg furthest from the ballet barre defining the forward leg and the leg closest to the ballet barre defining the rear leg.

98. The method according to embodiment 97, wherein the ballet exercise comprises positioning the unstable support apparatus adjacent to the ballet barre; orienting the back of the individual toward the ballet barre; and contacting the ballet barre for balance.

99. The method according to embodiment 98, wherein the ballet exercise further comprises reaching behind the individual to grasp the ballet barre with two hands substantially shoulder-width apart; and bending at the waist so as to bring the head in proximity to the knee of the forward leg.

100. The method according to embodiments 98 or 99, wherein the ballet exercise further comprises straightening at the waist while sliding the hands apart along the ballet barre; and pointing the toes of the foot of the forward leg, wherein the weight of the individual is primarily borne on the rear leg, the forward leg defining the active leg and the rear leg defining the support leg.

101. The method according to any one of embodiments 98-100, wherein the ballet exercise further comprises sliding the forward leg rearwardly; shifting the weight of the individual to the forward leg; and pointing the toes of the foot of the rear leg, the forward leg defining the support leg and the rear leg defining the active leg.

102. The method according to any one of embodiments 98-101, wherein the ballet exercise further comprises bringing the forward and rear legs together and crossing the feet in a tight leg position, with the toes of both feet pointed.

103. The method according to any one of embodiments 97-102, wherein the unstable support apparatus comprises a ball.

104. The method according to any one of embodiments 97-102, wherein the unstable support apparatus comprises a roller; and the roller is substantially perpendicular to the ballet barre.

105. The method according to embodiment 77, wherein the at least one limb comprises a first foot positioned on the unstable support apparatus, the leg of the first foot defining the support leg; and a second foot is not in contact with the unstable support apparatus, the leg of the second foot defining the active leg.

106. The method according to embodiment 105, wherein the ballet exercise further comprises standing on the unstable support apparatus on the support leg; and placing the second foot adjacent to the knee of the support leg, turning the active leg out at the hip.

107. The method according to embodiments 105 or 106, wherein the ballet exercise further comprises extending the active leg straight out in a forward direction with toes pointed, the active leg being substantially horizontal and the support leg being substantially vertical.

108. The method according to any one of embodiments 105-107, wherein the ballet exercise further comprises extending the active leg straight out in a lateral direction with toes pointed, the active leg being substantially horizontal and the support leg being substantially vertical.

109. The method according to any one of embodiments 105-108, wherein the ballet exercise further comprises extending the active leg straight out in a rearward direction with toes pointed, the active leg being substantially above horizontal and the support leg being substantially vertical.

110. The method according to any one of embodiments 105-109, wherein the unstable support apparatus comprises a ball.

111. The method according to any one of embodiments 105-110, wherein the unstable support apparatus comprises a roller; and the roller is substantially parallel to the ballet barre.

112. The method according to any one of embodiments 105-111, wherein the individual contacts the ballet barre for balance.

113. The method according to any one of embodiments 105-109, wherein the ballet exercise further comprises placing the second foot of the active leg on the ballet barre for support.

114. The method according to embodiment 113, wherein the support leg is substantially inclined in the direction of the active leg; and the torso is substantially vertical.

115. The method according to embodiment 113, wherein the support leg is substantially vertical; and the torso is substantially inclined in the direction of the active leg.

116. The method according to any one of embodiments 113-115, wherein the unstable support apparatus comprises a roller; and the roller is substantially perpendicular to the ballet barre.

117. A method for performing an exercise, the method comprising the steps of providing an unstable support apparatus and a stable support purchase, the unstable support apparatus being positioned atop a support surface; supporting the exerciser through at least one limb on the unstable support apparatus; placing at least a portion of the body in contact with the stable support purchase; maintaining a first exercise position; repositioning to a second exercise position; and maintaining the second exercise position.

118. The method of embodiment 117 wherein the unstable support apparatus is one of a ball and a roller.

119. The method of embodiment 117 wherein the stable support purchase is one or more of a wall-mounted ballet barre, a floor-mounted ballet barre, a free-standing ballet barre, an elongated bar, an elongated rail, a handhold, and a foothold.

120. The method of embodiment 117 wherein the at least one limb comprises both feet, with the feet positioned on the unstable support apparatus.

121. The method of embodiment 120 wherein one of the first exercise position and the second exercise position comprises turning the toes and hips out so that the heels are in proximity.

122. The method of embodiment 120 further comprising the steps of removing contact of the portion of the body from the stable support purchase; raising the arms over the head in one of the first exercise position and the second exercise position.

123. The method of embodiment 122 further comprising the step of bending the knees during the step of raising the arms over the head.

124. The method of embodiment 120 wherein one of the first exercise position and the second exercise position comprises bending at the waist to bring the head toward the knees with legs substantially straight.

125. The method of embodiment 120 wherein the unstable support apparatus is a roller, and one of the first exercise position and the second exercise position comprises the steps of positioning the roller transversely to the stable support purchase; positioning a first foot so that the sagittal plane of the first foot is transverse to a longitudinal axis of the roller; and positioning a second foot so that the sagittal plane of the first foot is substantially parallel to the longitudinal axis of the roller.

126. The method of embodiment 125 one of the first exercise position and the second exercise position comprises the steps of positioning the posterior of the body nearest to the stable support purchase; and placing a right hand and a left hand in contact with the stable support purchase.

127. The method of embodiment 125 wherein one of the first exercise position and the second exercise position comprises the steps of bending at the waist to bring the head toward the knees.

128. The method of embodiment 125 wherein one of the first exercise position and the second exercise position comprises the steps of standing substantially straight; positioning the first foot closest to the stable support purchase; positioning the second foot furthest from the stable support purchase; and lifting the heel of the second foot.

129. The method of embodiment 125 wherein one of the first exercise position and the second exercise position comprises the steps of standing substantially straight; shifting the body weight substantially to the first foot; removing the second foot from the unstable support apparatus; and repositioning the second foot behind the first foot and to one side of the unstable support apparatus.

130. The method of embodiment 120 wherein the unstable support apparatus is a roller, and one of the first exercise position and the second exercise position comprises the steps of positioning the roller transversely to the unstable support apparatus; positioning one of the right side and the left side of the body nearest to the stable support purchase; positioning the sagittal planes of a first foot and a second foot transversely to a longitudinal axis of the roller; and turning the toes and hips out so that the heels are in proximity.

131. The method of embodiment 130 further comprising the step of bending the waist to bring the head toward the knees.

132. The method of embodiment 130 further comprising the step of bending the legs at the knees.

133. The method of embodiment 132 further comprising the step of lifting the heel of both the first foot and the second foot.

134. The method of embodiment 120 wherein the unstable support apparatus is a roller, and one of the first exercise position and the second exercise position comprises the steps of positioning the roller transversely to the stable support purchase; positioning a first foot so that the sagittal plane of the first foot is transverse to a longitudinal axis of the roller; and lifting a second foot to one of a first height that is minimally above the first foot and a second height that is minimally above the waist.

135. The method of embodiment 134 further comprising the step of supporting the second foot on the stable support purchase with the right leg and the left leg held substantially straight.

136. The method of embodiment 135 wherein the roller is positioned either directly under the hip or to one side of the hip.

Aspects of the present specification may also be described as follows:

1. A method for performing a ballet exercise, the method comprising the steps of: providing an unstable support apparatus, a stable support apparatus and a support surface, the unstable support apparatus being positioned in direct contact with the support surface, wherein the unstable support apparatus is capable of rolling or shifting across the support surface while the exerciser is supported on the unstable support apparatus, the exerciser comprising a head, a waist, a first upper limb including a first arm and a first hand, a first lower limb including a first leg, a first knee and a first foot, a second upper limb including a second arm and a second hand, and a second lower limb including a second leg, a second knee and a second foot; supporting the exerciser through at least the first lower limb or the second lower limb on the unstable support apparatus, with the first foot or the second foot positioned on the unstable support apparatus; placing at least a portion of the first or the second upper limb in contact with the stable support apparatus, the portion of the first or the second upper limb comprising at least a first hand or a second hand of the exerciser; positioning to a first ballet foot position, the first ballet position comprising having the exerciser standing in a substantially vertical position with both the first foot and the second foot on the unstable support apparatus, the first foot and the second foot positioned with toes turned out from the sagittal plane and heels in close proximity to each other; and maintaining the first ballet foot position.

2. The method of embodiment 1, wherein the unstable support apparatus is a substantially spherical ball that is non-rigid, conformable, and capable of rolling or shifting.

3. The method of embodiment 1, wherein the unstable support apparatus is a substantially cylindrical roller that is non-rigid, conformable, and capable of rolling.

4. The method of embodiment 1, wherein the unstable support apparatus is a rotational disc, and capable of rotating.

5. The method of any one of embodiments 1-4, wherein the support surface is a floor or a wall 6. The method of any one of embodiments 1-5, wherein the stable support apparatus is one or more of a wall-mounted ballet barre, a floor-mounted ballet barre, a free-standing ballet barre, an elongated bar, an elongated rail, a handhold, and a foothold.

7. The method of any one of embodiments 1-6, wherein from the first ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

8. The method of embodiment 7, wherein the ballet arm position is a first ballet arm position, a second ballet arm position, a third ballet arm position, a fourth ballet arm position, or a fifth ballet arm position.

9. The method of any one of embodiments 1-8, wherein the step of maintaining the first ballet foot position comprises holding the first ballet position in an isometric state for two to four minutes.
10. The method of any one of embodiments 1-9, wherein the exerciser repositions to a second ballet foot position by sliding either the first foot or the second foot out until approximately shoulder width apart from each other, the second ballet foot position comprising having the exerciser standing in a substantially vertical position with both the first foot and the second foot on the unstable support apparatus, the first foot and the second foot positioned with toes turned out from the sagittal plane and heels approximately shoulder width apart from each other; and maintaining the second ballet position.
11. The method of embodiment 10, wherein from the second ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
12. The method of embodiment 11, wherein the ballet arm position is a first ballet arm position, a second ballet arm position, a third ballet arm position, a fourth ballet arm position, or a fifth ballet arm position.
13. The method of any one of embodiments 10-12, wherein the step of maintaining the second ballet foot position comprises holding the second ballet position in an isometric state for two to four minutes.
14. The method of any one of embodiments 1-13, further comprising repositioning to a third ballet foot position by bringing either the first foot or the second foot inward in a sagittal direction until the heel of one foot is positioned to the middle of the other foot, the third ballet foot position comprising having the exerciser standing in a substantially vertical position with the first and second feet in close proximity to each other and in directional alignment with the sagittal plane and having each heel positioned to the middle of the other foot, the first foot and the second foot positioned with toes turned out about 90 degrees from the sagittal plane; and maintaining the fourth ballet position.
15. The method of embodiment 13, wherein from the third ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
16. The method of embodiment 15, wherein the ballet arm position is a first ballet arm position, a second ballet arm position, a third ballet arm position, a fourth ballet arm position, or a fifth ballet arm position.
17. The method of any one of embodiments 14-16, wherein the step of maintaining the third ballet foot position comprises holding the third ballet position in an isometric state for two to four minutes.
18. The method of any one of embodiments 1-17, further comprising repositioning to a fourth foot ballet position by bringing the first foot in front of the second foot, the fourth ballet foot position comprising having the exerciser standing in a substantially vertical position with both the first foot and the second foot on the unstable support apparatus with the first foot positioned approximately one foot length apart of the second foot and the first foot and the second foot positioned with toes turned out from the sagittal plane; and maintaining the fourth ballet position.
19. The method of embodiment 18, wherein from the fourth ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
20. The method of embodiment 19, wherein the ballet arm position is a first ballet arm position, a second ballet arm position, a third ballet arm position, a fourth ballet arm position, or a fifth ballet arm position.
21. The method of any one of embodiments 18-20, wherein the step of maintaining the fourth ballet foot position comprises holding the fourth ballet position in an isometric state for two to four minutes.
22. The method of any one of embodiments 1-21, further comprising repositioning to a fifth ballet foot position by bringing the first foot back toward the second foot, the fifth ballet foot position comprising having the exerciser standing in a substantially vertical position with both the first foot and the second foot on the unstable support apparatus with the first foot in proximity to the second foot and the first foot and the second foot positioned with toes turned out from the sagittal plane; and maintaining the fifth ballet position.
23. The method of embodiment 22, wherein from the fifth ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

24. The method of embodiment 23, wherein the ballet arm position is a first ballet arm position, a second ballet arm position, a third ballet arm position, a fourth ballet arm position, or a fifth ballet arm position.
25. The method of any one of embodiments 22-24, wherein the step of maintaining the fifth ballet foot position comprises holding the fifth ballet position in an isometric state for two to four minutes.
26. The method of any one of embodiments 1-25, further comprising a resistance apparatus, the resistance apparatus
27. The method of embodiment 26, wherein the resistance apparatus is a resistance band, a resistance tube, or a resistance loop.

Aspects of the present specification may also be described as follows:

1. A method for performing a ballet exercise, the method comprising the steps of: providing an unstable support apparatus, a stable support apparatus and a support surface, the unstable support apparatus being a substantially spherical ball that is non-rigid, conformable, and capable of rolling or a substantially cylindrical roller that is non-rigid, conformable, and capable of rolling, wherein the unstable support apparatus is capable of forming a dimple at a point of contact with an exerciser while the exerciser is supported on the unstable support apparatus, the unstable support apparatus being positioned in direct contact with the support surface, the support surface being a floor or a wall, wherein the unstable support apparatus is capable of rolling across the support surface while the exerciser is supported on the unstable support apparatus, the exerciser comprising a head, a waist, a first upper limb including a first arm and a first hand, a first lower limb including a first leg, a first knee and a first foot, a second upper limb including a second arm and a second hand, and a second lower limb including a second leg, a second knee and a second foot; supporting the exerciser through at least the first lower limb or the second lower limb on the unstable support apparatus, with the first foot or the second foot positioned on the unstable support apparatus; placing at least a portion of the first or the second upper limb in contact with the stable support apparatus, the portion of the first or the second upper limb comprising at least a first hand or a second hand of the exerciser; positioning to a first ballet position, the first ballet position comprising having the exerciser standing in a substantially vertical position with both the first foot and the second foot on the unstable support apparatus, the first foot and the second foot positioned with toes turned out from the sagittal plane and heels in close proximity to each other; maintaining the first ballet position; repositioning to a second ballet position by sliding either the first foot or the second foot out until approximately shoulder width apart from each other, the second ballet position comprising having the exerciser standing in a substantially vertical position with both the first foot and the second foot on the unstable support apparatus, the first foot and the second foot positioned with toes turned out from the sagittal plane and heels approximately shoulder width apart from each other; and maintaining the second ballet position.
2. The method of claim 1, wherein the unstable support apparatus is the substantially spherical ball.
3. The method of embodiment 1, wherein the stable support apparatus is one or more of a wall-mounted ballet barre, a floor-mounted ballet barre, a free-standing ballet barre, an elongated bar, an elongated rail, a handhold, and a foothold.
4. The method of embodiment 1, further comprising repositioning to a fourth ballet position by bringing the first foot in front of the second foot, the fourth ballet position comprising having the exerciser standing in a substantially vertical position with both the first foot and the second foot on the unstable support apparatus with the first foot positioned approximately one foot length apart of the second foot and the first foot and the second foot positioned with toes turned out from the sagittal plane; and maintaining the fourth ballet position.
5. The method of embodiment 4, further comprising repositioning to a fifth ballet position by bringing the first foot back toward the second foot, the fifth ballet position comprising having the exerciser standing in a substantially vertical position with both the first foot and the second foot on the unstable support apparatus with the first foot in proximity to the second foot and the first foot and the second foot positioned with toes turned out from the sagittal plane; and maintaining the fifth ballet position.
6. The method of embodiment 1, further comprising the steps of: repositioning to an en haut position while in the first ballet position and/or the second ballet position by removing contact of the portion of the first or the second upper limb from the stable support apparatus and raising the first and second upper limbs over the head in a relatively high, substantially oval shape.
7. The method of embodiment 6, further comprising the step of: repositioning to a demi plie position by bending the knees to a half position while maintaining the en haut position
8. The method of embodiment 7, further comprising the step of: repositioning to a grande plie position by deeply bending the first and second knees while maintaining the en haut position.
9. The method of embodiment 1, further comprising the step of: repositioning to a cambre position while in the first ballet position and/or the second ballet position by bending at the waist to bring the head toward the first and second knees with the first and second legs substantially straight.
10. The method of embodiment 1, further comprising the step of: repositioning to a passe position while in the first ballet position and/or the second ballet position by either bending the first knee of the first leg and lifting the first foot to a position in proximity to the second knee of the second leg or bending the second knee of the second leg and lifting the second foot to a position in proximity to the first knee of the first leg.
11. The method of embodiment 4, further comprising the steps of: repositioning to an en haut position while in the fourth ballet position by removing contact of the portion of the first or the second upper limb from the stable support apparatus and raising the first and second upper limbs over the head in a relatively high, substantially oval shape.
12. The method of embodiment 11, further comprising the step of: repositioning to a demi plie position by bending the knees to a half position while maintaining the en haut position.

13. The method of embodiment 12, further comprising the step of: repositioning to a grande plie position by deeply bending the first and second knees while maintaining the en haut position.
14. The method of embodiment 4, further comprising the step of: repositioning to a cambre position while in the fourth ballet position by bending at the waist to bring the head toward the first and second knees with the first and second legs substantially straight.
15. The method of embodiment 4, further comprising the step of: repositioning to a passe position while in the fourth ballet position by either bending the first knee of the first leg and lifting the first foot to a position in proximity to the second knee of the second leg or bending the second knee of the second eg and lifting the second foot to a position in proximity to the first knee of the first leg.
16. The method of embodiment 5, further comprising the step of: repositioning to an en haut position while in the fifth ballet position by removing contact of the portion of the first or the second upper limb from the stable support apparatus and raising the first and second upper limbs over the head in a relatively high, substantially oval shape.
17. The method of embodiment 16, further comprising the step of: repositioning to a demi plie position by bending the first and second knees to a half position while maintaining the en haut position.
18. The method of embodiment 16, further comprising the step of: repositioning to a grande plie position by deeply bending the first and second knees while maintaining the en haut position.
19. The method of embodiment 5, further comprising the step of: repositioning to a cambre position in maintaining the fifth ballet position by bending at the waist to bring the head toward the first and second knees with the first and second legs substantially straight.
20. The method of embodiment 5, further comprising the step of: repositioning to a passe position while in the fifth ballet position by either bending the first knee of the first leg and lifting the first foot to a position in proximity to the second knee of the second leg or bending the second knee of the second leg and lifting the second foot to a position in proximity to the first knee of the first leg.
21. The method of embodiment 1, wherein the step of maintaining the first ballet position and/or the second ballet position comprises holding the first ballet position in an isometric state for two to four minutes.
22. The method of embodiment 4, wherein the step of maintaining the fourth ballet position comprises holding the fourth ballet position in an isometric state for two to four minutes.
23. The method of embodiment 5, wherein the step of maintaining the fifth ballet position comprises holding the fifth ballet position in an isometric state for two to four minutes.
24. The method of embodiment 10, further comprising the step of: repositioning to a developpe devant position while in the first ballet position and/or the second ballet position by extending the first leg straight out in a forward direction with toes pointed, the first leg being substantially horizontal and the second leg being substantially vertical; or repositioning to a developpe passe position while in the first ballet position and/or the second ballet position by extending the first leg straight out in a lateral direction with toes pointed, the first leg being substantially horizontal and the second leg being substantially vertical; or repositioning to a fondue arabesque position while in the first ballet position and/or the second ballet position by extending the first leg straight out in a rearward direction with toes pointed, the first leg being substantially horizontal and the second leg being substantially vertical.
25. The method of embodiment 15, further comprising the step of: repositioning to a developpe devant position while in the fourth ballet position by extending the first leg straight out in a forward direction with toes pointed, the first leg being substantially horizontal and the second leg being substantially vertical; or repositioning to a developpe passe position while in the fourth ballet position by extending the first leg straight out in a lateral direction with toes pointed, the first leg being substantially horizontal and the second leg being substantially vertical; or repositioning to a fondue arabesque position while in the fourth ballet position by extending the first leg straight out in a rearward direction with toes pointed, the first leg being substantially horizontal and the second leg being substantially vertical.
26. The method of embodiment 20, further comprising the step of: repositioning to a developpe devant position while in the fifth ballet position by extending the first leg straight out in a forward direction with toes pointed, the first leg being substantially horizontal and the second leg being substantially vertical; or repositioning to a developpe passe position while in the fifth ballet position by extending the first leg straight out in a lateral direction with toes pointed, the first leg being substantially horizontal and the second leg being substantially vertical; or repositioning to a fondue arabesque position while in the fifth ballet position by extending the first leg straight out in a rearward direction with toes pointed, the first leg being substantially horizontal and the second leg being substantially vertical.

Aspects of the present specification may also be described as follows:

1. A method for performing a ballet exercise, the method comprising the steps of: providing an unstable support apparatus that is a rotational disc, a resistance apparatus, a stable support apparatus and a support surface, the unstable support apparatus being positioned in direct contact with the support surface, wherein the unstable support apparatus is capable of rotating is an axial direction horizontal to the support surface while the exerciser is supported on the unstable support apparatus, the exerciser comprising a head, a waist, a first upper limb including a first arm and a first hand, a first lower limb including a first leg, a first knee and a first foot, a second upper limb including a second arm and a second hand, and a second lower limb including a second leg, a second knee and a second foot; supporting the exerciser through at least the first lower limb or the second lower limb on the unstable support apparatus, with the first foot or the second foot positioned on the unstable support apparatus; placing at least a portion of the first or the second upper limb in contact with the resistance apparatus, the portion of the first or the second upper limb comprising at least a first hand or a second hand of the exerciser; positioning to a first ballet foot position, the first ballet position comprising having the exerciser standing in a substantially vertical position with both the first foot and the second foot on the unstable support apparatus, the first foot and the second foot positioned with toes turned out from the sagittal plane and heels in close proximity to each other; and maintaining the first ballet foot position.

2. The method of embodiment 1, wherein the resistance apparatus is a resistance band, a resistance tube, or a resistance loop.
3. The method of any one of embodiment 1 or 2, wherein the support surface is a floor or a wall.
4. The method of any one of embodiment 1-3 wherein the stable support apparatus is one or more of a wall-mounted ballet barre, a floor-mounted ballet barre, a free-standing ballet barre, an elongated bar, an elongated rail, a hand-hold, and a foothold.
5. The method of any one of embodiments 1-4, wherein from the first ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
6. The method of embodiment 5, wherein the ballet arm position is a first ballet arm position, a second ballet arm position, a third ballet arm position, a fourth ballet arm position, or a fifth ballet arm position.
7. The method of any one of embodiments 1-6, wherein the step of maintaining the first ballet foot position comprises holding the first ballet position in an isometric state for two to four minutes.
8. The method of any one of embodiments 1-7, wherein the exerciser repositions to a second ballet foot position by sliding either the first foot or the second foot out until approximately shoulder width apart from each other, the second ballet foot position comprising having the exerciser standing in a substantially vertical position with both the first foot and the second foot on the unstable support apparatus, the first foot and the second foot positioned with toes turned out from the sagittal plane and heels approximately shoulder width apart from each other; and maintaining the second ballet position.
9. The method of embodiment 8, wherein from the second ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
10. The method of embodiment 9, wherein the ballet arm position is a first ballet arm position, a second ballet arm position, a third ballet arm position, a fourth ballet arm position, or a fifth ballet arm position.
11. The method of any one of embodiments 8-10, wherein the step of maintaining the second ballet foot position comprises holding the second ballet position in an isometric state for two to four minutes.
12. The method of any one of embodiments 1-11, further comprising repositioning to a third ballet foot position by bringing either the first foot or the second foot inward in a sagittal direction until the heel of one foot is positioned to the middle of the other foot, the third ballet foot position comprising having the exerciser standing in a substantially vertical position with the first and second feet in close proximity to each other and in directional alignment with the sagittal plane and having each heel positioned to the middle of the other foot, the first foot and the second foot positioned with toes turned out about 90 degrees from the sagittal plane; and maintaining the fourth ballet position.
13. The method of embodiment 12, wherein from the third ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
14. The method of embodiment 13, wherein the ballet arm position is a first ballet arm position, a second ballet arm position, a third ballet arm position, a fourth ballet arm position, or a fifth ballet arm position.
15. The method of any one of embodiments 12-14, wherein the step of maintaining the third ballet foot position comprises holding the third ballet position in an isometric state for two to four minutes.
16. The method of any one of embodiments 1-15, further comprising repositioning to a fourth foot ballet position by bringing the first foot in front of the second foot, the fourth ballet foot position comprising having the exerciser standing in a substantially vertical position with both the first foot and the second foot on the unstable support apparatus with the first foot positioned approximately one foot length apart of the second foot and the first foot and the second foot positioned with toes turned out from the sagittal plane; and maintaining the fourth ballet position.
17. The method of embodiment 16, wherein from the fourth ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

18. The method of embodiment 17, wherein the ballet arm position is a first ballet arm position, a second ballet arm position, a third ballet arm position, a fourth ballet arm position, or a fifth ballet arm position.
19. The method of any one of embodiments 16-18, wherein the step of maintaining the fourth ballet foot position comprises holding the fourth ballet position in an isometric state for two to four minutes.
20. The method of any one of embodiments 1-19, further comprising repositioning to a fifth ballet foot position by bringing the first foot back toward the second foot, the fifth ballet foot position comprising having the exerciser standing in a substantially vertical position with both the first foot and the second foot on the unstable support apparatus with the first foot in proximity to the second foot and the first foot and the second foot positioned with toes turned out from the sagittal plane; and maintaining the fifth ballet position.
21. The method of embodiment 20, wherein from the fifth ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.
22. The method of embodiment 21, wherein the ballet arm position is a first ballet arm position, a second ballet arm position, a third ballet arm position, a fourth ballet arm position, or a fifth ballet arm position.
23. The method of any one of embodiments 20-22, wherein the step of maintaining the fifth ballet foot position comprises holding the fifth ballet position in an isometric state for two to four minutes.

EXAMPLES

The following non-limiting examples are provided for illustrative purposes only in order to facilitate a more complete understanding of representative embodiments now contemplated. These examples should not be construed to limit any of the embodiments described in the present specification, including those pertaining to the compounds, pharmaceutical compositions, or methods and uses disclosed herein.

Example 1

Ballet Dancer Strength Training and Back Rehabilitation

This example demonstrates the implementation of an exercise system and method according to aspects of the present specification in strength training and back rehabilitation for a ballet dancer.

A 26-year-old female ballet dancer had become increasingly limited in her ability to dance and essentially could no longer dance pain free due to chronic back issues resulting from muscular imbalance and leading to scoliosis with an upper back curvature of 30 degrees and a lower back curvature of 21 degrees and so even calling for a back brace. After three months of five one-and-a-half-hour exercise sessions per week involving isometric and isotonic ballet movements on an unstable ball or foam roller surface, the dancer's strength and range of motion and resulting dancing and confidence were much improved. Specifically, upper back curvature was improved to 27 degrees and lower back curvature to 19 degrees in part due to the elimination of strength discrepancies.

Example 2

Rehabilitation of Gymnast's Broken Ankle

This example demonstrates the implementation of an exercise system and method according to aspects of the present specification in rehabilitation of a gymnast's broken ankle.

A 15-year-old female competition gymnast and ballet student shattered her ankle in a gymnastics accident and after major surgery with hardware installed she was faced with a long road to recovery estimated at a year or more, even then it being uncertain to what extent she would be able to regain her gymnastics form or ever again perform certain skills on the balance beam or in ballet get back "en pointe" (bear weight on the fully vertically extended foot, as on the toes). After nine months of two to three one-and-a-half-hour exercise sessions per week involving isometric and isotonic ballet movements on an unstable ball or foam roller surface, the strength and range of motion returned to the gymnast's injured ankle and foot and she was back "en pointe" and competing in gymnastics in less than a year following the injury. The gymnast's surgeon was baffled by her quick and complete recovery from such a devastating injury.

Example 3

Rehabilitation of Ice Skater's Torn Calf

This example demonstrates the implementation of an exercise system and method according to aspects of the present specification in rehabilitating an ice skater's torn calf muscle.

A 16-year-old female amateur ice skater with a performance and competition skating company suffered a torn calf, an injury that typically requires 4-8 weeks for recovery. After just five one-hour exercise sessions involving isometric and isotonic ballet movements on an unstable ball or foam roller surface over the span of two weeks, the skater had essentially fully recovered and was able to go back on the ice for a competition short program less than three weeks after the injury.

Example 4

Martial Arts Strength, Balance, and Flexibility Training

This example demonstrates the implementation of an exercise system and method according to aspects of the present specification in martial arts strength, balance, and flexibility training.

A 20-year old male black belt in taekwondo was interested in gaining strength and flexibility so as to perform even more challenging martial arts skills, particularly after a roughly six-month lay-off. After two months of two to three one-and-a-half-hour exercise sessions per week involving isometric and isotonic ballet movements on an unstable ball or foam roller surface, his strength, balance, and flexibility were greatly improved, prompting his doctor to note a marked increase of lean muscle mass and to ask if he was weight training and his taekwondo master teacher to express delight and wonder regarding his improvements in such a short period of time, particularly noting the six-month lay-off and thus expecting his student to improve relatively slowly, not more quickly; in fact, only two weeks or six sessions into the exercise program, the master teacher remarked that the student showed considerable improvement in energy level, speed, core strength, balance, and an increased vertical leap, and so after only six weeks the black belt student had passed his second degree requirements, and he then completed his third degree black belt requirements by the fourth month.

Example 5

Ballet Dancer Hip Injury Rehabilitation

This example demonstrates the implementation of an exercise system and method according to aspects of the present specification in rehabilitating a ballet dancer hip injury.

A 33-year-old female professional ballet dancer with a touring company had been enduring a nagging or chronic hip injury for about eight years, when it finally got to the point that she could no longer dance and was forced to leave the company, with her condition only worsening over time through ballet training alone, not improving. In addition and further complicating her training, the dancer was hyper mobile and flexible, to the point that her body—muscles, ligaments, and tendons—was so weakened, as in overstretched, that she was at higher risk of further injury. After nine months of two to three one-and-a-half-hour exercise sessions per week involving isometric and isotonic ballet movements on an unstable ball or foam roller surface, the strength and range of motion returned to the gymnast's injured hip and she was able to return to company work, now executing higher extensions and longer lines in all her movements and with increased turnout as well.

Example 6

Broken Back Spinal Rehabilitation

This example demonstrates the implementation of an exercise system and method according to aspects of the present specification in broken back spinal rehabilitation.

An 18-year-old male dance student suffered the effects of a broken back as a gymnast years before and was still not able to dance pain free, to the point that he left the full-time dance program he was in. In only three weeks or less than ten exercise sessions involving isometric and isotonic ballet movements on an unstable ball or foam roller surface, most of the dancer's pain was eliminated. Continued one- to one-and-a-half-hour sessions at least twice per week over the following six months resulted in substantially complete spinal rehabilitation, returning the dancer to his full-time dance program two levels higher than when he left.

Example 7

Rehabilitation of Ballet Dancer's Torn Ankle

This example demonstrates the implementation of an exercise system and method according to aspects of the present specification in rehabilitation of a ballet dancer's torn ankle.

A 22-year-old female ballet dancer had suffered torn ligaments in her ankle four years earlier that limited her ability to improve her ballet skills beyond a certain point and often held her work-outs back simply because of chronic pain and relative weakness in the previously injured ankle; the severity of the injury and the demands of ballet dancing had led some to believe that the injury would even prevent her from ever dancing again. As noted, she was still dancing, but in pain and having plateaued due to the ankle injury. However, after six months of two to three one-and-a-half-hour exercise sessions per week involving isometric and isotonic ballet movements on an unstable ball or foam roller surface, the strength and full range of motion returned to the dancer's injured ankle and she was back dancing and "en pointe" pain free for the first time since before her injury nearly five years earlier.

Example 8

Ballet Dancer Strength, Balance, and Flexibility Training

This example demonstrates the implementation of an exercise system and method according to aspects of the present specification in ballet dancer strength, balance, and flexibility training.

A 24-year-old male had an interest in becoming a ballet dancer but had no formal training to that point. Incredibly, after only eight months of three to five one-and-a-half-hour exercise sessions per week involving isometric and isotonic ballet movements on an unstable ball or foam roller surface, he was able to join a professional, touring dance company, a feat that typically takes a dancer years to accomplish.

Example 9

Improvement of Basketball Player's Vertical Leap

This example demonstrates the implementation of an exercise system and method according to aspects of the present specification in improving a basketball player's vertical leap.

A 17-year-old male basketball player standing only 6' 1" tall desired to dunk a basketball on a regulation 10'-tall basketball goal and had never before been able to despite numerous attempts and tremendous effort including weight lifting, wearing ankle weights, resistance training, and the like. After only three months of two to three one-hour exercise sessions per week involving isometric and isotonic ballet movements on an unstable ball or foam roller surface, particularly including knee bends (a "plie" in ballet), the player's ankles and knees were strengthened and his vertical leap improved an incredible six inches, enabling him to achieve his goal of dunking a basketball.

Example 10

Sprinter Training

This example demonstrates the implementation of an exercise system and method according to aspects of the present specification in sprinter training.

A 21-year-old male collegiate sprinter desired to improve his 100-meter dash time in his senior season, which seemed to have leveled off over the past two years for him—he had "hit the ceiling" and could not make any further progress in shaving even fractions of a second off of his personal best time of 10.15 seconds. His goal of sub-10 seconds seemed hopelessly out of reach. He then heard about and decided to try an exercise regimen involving isometric and isotonic ballet movements on an unstable ball or foam roller surface, having known that legendary sprinter Carl Lewis had included ballet classes in his training. Incredibly, after four months of off-season training including two to three one-hour ballet-type exercise sessions per week, the sprinter was able to get his 100-meter dash times down to around ten seconds fairly consistently in practice and ultimately accomplished his goal by posting a personal and meet-best time of 9.98 seconds in the 100-meter dash during his senior season in college.

In closing, it is to be understood that, although aspects of the present specification are highlighted by referring to specific embodiments, one skilled in the art will readily appreciate that these described embodiments are only illustrative of the principles of the subject matter disclosed herein. The specific embodiments are not intended to be exhaustive or to limit the invention to the precise forms disclosed. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the scope of the invention is not to be limited by this detailed description. Furthermore, it is intended that the following appended claims and claims hereafter introduced are interpreted to include all such changes, modifications, permutations, alterations, additions, subtractions and sub-combinations as are within their true spirit and scope.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified, thus fulfilling the written description of all Markush groups used in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

All patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

Lastly, the terminology used herein is for the purpose of describing particular embodiments only and is not intended to limit the scope of the present invention, which is defined solely by the claims. Accordingly, the present invention is not limited to that precisely as shown and described.

The invention claimed is:

1. A method for performing a ballet exercise, the method comprising the steps of:

providing an unstable support apparatus that is a rotational disc, a resistance apparatus, a stable support apparatus and a support surface, the unstable support apparatus being positioned in direct contact with the support surface, wherein the unstable support apparatus is capable of rotating is an axial direction horizontal to the support surface while the exerciser is supported on the unstable support apparatus, the exerciser comprising a head, a waist, a first upper limb including a first arm and a first hand, a first lower limb including a first leg, a first knee and a first foot, a second upper limb including a second arm and a second hand, and a second lower limb including a second leg, a second knee and a second foot;

supporting the exerciser through at least the first lower limb or the second lower limb on the unstable support apparatus, with the first foot or the second foot positioned on the unstable support apparatus;

placing at least a portion of the first or the second upper limb in contact with the resistance apparatus, the portion of the first or the second upper limb comprising at least a first hand or a second hand of the exerciser;

positioning to a first ballet foot position, the first ballet position comprising having the exerciser standing in a substantially vertical position with both the first foot and the second foot on the unstable support apparatus, the first foot and the second foot positioned with toes turned out from the sagittal plane and heels in close proximity to each other; and maintaining the first ballet foot position.

2. The method of claim 1, wherein the resistance apparatus is a resistance band, a resistance tube, or a resistance loop.

3. The method of claim 1, wherein the support surface is a floor or a wall.

4. The method of claim 1, wherein the stable support apparatus is one or more of a wall-mounted ballet barre, a floor-mounted ballet barre, a free-standing ballet barre, an elongated bar, an elongated rail, a handhold, and a foothold.

5. The method of claim 1, wherein from the first ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

6. The method of claim 5, wherein the ballet arm position is a first ballet arm position, a second ballet arm position, a third ballet arm position, a fourth ballet arm position, or a fifth ballet arm position.

7. The method of claim 1, wherein the exerciser repositions to a second ballet foot position by sliding either the first foot or the second foot out until approximately shoulder width apart from each other, the second ballet foot position comprising having the exerciser standing in a substantially vertical position with both the first foot and the second foot on the unstable support apparatus, the first foot and the second foot positioned with toes turned out from the sagittal plane and heels approximately shoulder width apart from each other; and maintaining the second ballet position.

8. The method of claim 7, wherein from the second ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

9. The method of claim 8, wherein the ballet arm position is a first ballet arm position, a second ballet arm position, a third ballet arm position, a fourth ballet arm position, or a fifth ballet arm position.

10. The method of claim 1, further comprising repositioning to a third ballet foot position by bringing either the first foot or the second foot inward in a sagittal direction until the heel of one foot is positioned to the middle of the other foot, the third ballet foot position comprising having the exerciser standing in a substantially vertical position with the first and second feet in close proximity to each other and in directional alignment with the sagittal plane and having each heel positioned to the middle of the other foot, the first foot and the second foot positioned with toes turned out about 90 degrees from the sagittal plane; and maintaining the fourth ballet position.

11. The method of claim 10, wherein from the third ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

12. The method of claim 11, wherein the ballet arm position is a first ballet arm position, a second ballet arm position, a third ballet arm position, a fourth ballet arm position, or a fifth ballet arm position.

13. The method of a claim 1, further comprising repositioning to a fourth foot ballet position by bringing the first foot in front of the second foot, the fourth ballet foot position comprising having the exerciser standing in a substantially vertical position with both the first foot and the second foot on the unstable support apparatus with the first foot positioned approximately one foot length apart of the second foot and the first foot and the second foot positioned with toes turned out from the sagittal plane; and maintaining the fourth ballet position.

14. The method of claim 13, wherein from the fourth ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

15. The method of claim 14, wherein the ballet arm position is a first ballet arm position, a second ballet arm position, a third ballet arm position, a fourth ballet arm position, or a fifth ballet arm position.

16. The method of claim 1, further comprising repositioning to a fifth ballet foot position by bringing the first foot back toward the second foot, the fifth ballet foot position comprising having the exerciser standing in a substantially vertical position with both the first foot and the second foot on the unstable support apparatus with the first foot in proximity to the second foot and the first foot and the second foot positioned with toes turned out from the sagittal plane; and maintaining the fifth ballet position.

17. The method of claim 16, wherein from the fifth ballet foot position further comprising the individual performing a ballet arm position, another arm position, an adagio movement, an allegro movement, an allongé movement, an arabesque movement, an attitude movement, a balance movement, a balancire movement, a ballonné movement, a battement movement, a battu movement, a bourree movement a cambré movement, a dedans movement, a dehors movement, a developpe movement, an échappe movement, an entrechat movement, an épailé movement, an epaulement movement, a fondu movement, a jeté movement, a passé movement, a penché movement, a piqué movement, a plié movement, a pointe movement, a poisson movement, a port de bras movement, a posé movement, a relevé movement, a retiré movement, a tendu movement, or any combination thereof.

18. The method of claim 17, wherein the ballet arm position is a first ballet arm position, a second ballet arm position, a third ballet arm position, a fourth ballet arm position, or a fifth ballet arm position.

* * * * *